US011024262B2

(12) United States Patent
Lee et al.

(10) Patent No.: US 11,024,262 B2
(45) Date of Patent: Jun. 1, 2021

(54) METHOD FOR COMPENSATING FOR SCREEN MOVEMENT OF DISPLAY AND ELECTRONIC DEVICE FOR SUPPORTING THE SAME

(71) Applicant: Samsung Electronics Co., Ltd., Suwon-si (KR)

(72) Inventors: Jaesung Lee, Suwon-si (KR); Jiyong Kim, Suwon-si (KR); Jinhyun Kim, Suwon-si (KR); Taehyeong Kim, Suwon-si (KR); Jungbae Bae, Suwon-si (KR); Jongkon Bae, Suwon-si (KR); Byungduk Yang, Suwon-si (KR); Yohan Lee, Suwon-si (KR); Dongkyoon Han, Suwon-si (KR); Yunpyo Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/895,528

(22) Filed: Jun. 8, 2020

(65) Prior Publication Data

US 2020/0388245 A1 Dec. 10, 2020

(30) Foreign Application Priority Data

Jun. 7, 2019 (KR) ..... 10-2019-0067604
May 25, 2020 (KR) ..... 10-2020-0062430

(51) Int. Cl.

| | |
|---|---|
| ***G09G 5/34*** | (2006.01) |
| ***G09G 3/20*** | (2006.01) |
| ***G09G 5/37*** | (2006.01) |

(52) U.S. Cl.
CPC ..... *G09G 5/34* (2013.01); *G09G 3/20* (2013.01); *G09G 5/37* (2013.01); *G09G 2320/0261* (2013.01); *G09G 2354/00* (2013.01)

(58) Field of Classification Search
CPC .. G09G 5/34; G09G 3/20; G09G 5/37; G09G 2320/0261; G09G 2354/00
See application file for complete search history.

(56) References Cited

U.S. PATENT DOCUMENTS 7,158,118 B2 1/2007 Liberty
7,262,760 B2 8/2007 Liberty
(Continued)

FOREIGN PATENT DOCUMENTS

KR 10-2010-0096257 A 9/2010

OTHER PUBLICATIONS

International Search Report dated Sep. 21, 2020 issued for the corresponding International patent application (Appl. No. PCT/KR2020/007397).

(Continued)

*Primary Examiner* — Haixia Du
(74) *Attorney, Agent, or Firm* — Jefferson IP Law, LLP

(57) ABSTRACT

An electronic device is provided. The electronic device includes a display for outputting a screen and a processor operatively connected to the display. The processor is configured to receive a user input associated with movement of a screen output on the display, detect a screen movement speed corresponding to the user input associated with the screen movement, determine an amount of screen tilt compensation corresponding to the screen movement based on the screen movement speed, when the screen movement speed is included in a first interval, and keep the amount of screen tilt compensation based on the screen movement (Continued)

speed constant, when the screen movement speed is included in a second interval faster than the first interval.

19 Claims, 18 Drawing Sheets

(56) References Cited

U.S. PATENT DOCUMENTS

| | | | |
|---|---|---|---|
| 7,414,611 | B2 | 8/2008 | Liberty |
| 7,940,241 | B2 | 5/2011 | Bae et al. |
| 8,015,490 | B2 | 9/2011 | Ogikubo |
| 8,072,424 | B2 | 12/2011 | Liberty |
| 8,111,237 | B2 | 2/2012 | Yamagishi |
| 8,571,386 | B2 | 10/2013 | Shimizu et al. |
| 8,648,788 | B2 | 2/2014 | Bae et al. |
| 8,681,093 | B2 | 3/2014 | Lee et al. |
| 9,030,419 | B1 | 5/2015 | Freed |
| 10,152,938 | B2 | 12/2018 | Lee et al. |
| 10,380,950 | B2 | 8/2019 | Chang |
| 2009/0201246 | A1 | 8/2009 | Lee et al. |
| 2009/0237347 | A1 | 9/2009 | Yamagishi |
| 2009/0322661 | A1 | 12/2009 | Bae et al. |
| 2010/0220978 | A1 | 9/2010 | Ogikubo |
| 2011/0175865 | A1 | 7/2011 | Bae et al. |
| 2012/0069204 | A1 | 3/2012 | Shimizu et al. |
| 2014/0118399 | A1* | 5/2014 | Todorovich ..... G06T 3/4038 345/634 |
| 2015/0040059 | A1 | 2/2015 | Yuan |
| 2016/0196797 | A1 | 7/2016 | Lee et al. |
| 2016/0225349 | A1 | 8/2016 | Lee et al. |
| 2018/0090078 | A1 | 3/2018 | Chang |

OTHER PUBLICATIONS

Extended European Search Report dated Nov. 19, 2020 issued for the corresponding European patent application—Appl. No. 20178731.4.

* cited by examiner

<1 Duty AOR 1.4%(LEFT)>, 4 Duty AOR 30.0%(RIGHT)>

METHOD FOR COMPENSATING FOR SCREEN MOVEMENT OF DISPLAY AND ELECTRONIC DEVICE FOR SUPPORTING THE SAME

CROSS-REFERENCE TO RELATED APPLICATION(S)

This application is based on and claims priority under 35 U.S.C. § 119(a) of a Korean patent application number 10-2019-0067604, filed on Jun. 7, 2019, in the Korean Intellectual Property Office, and a Korean patent application number 10-2020-0062430, filed on May 25, 2020, in the Korean Intellectual Property Office, the disclosure of each of which is incorporated by reference herein its entirety.

BACKGROUND

1. Field

The disclosure relates to a method for compensating for a jelly scroll phenomenon during screen movement of a display. More particularly, the disclosure relates to an electronic device and method for compensating for screen movement of a display for naturally displaying screen movement.

2. Description of Related Art

An electronic device of the related art may include a display and may visually provide a user with a variety of screens on the display. The electronic device may include a display and a display driver integrated circuit (DDI) for driving the display. The DDI loaded into the electronic device may receive display data from a processor to drive the display.

The above information is presented as background information only to assist with an understanding of the disclosure. No determination has been made, and no assertion is made, as to whether any of the above might be applicable as prior art with regard to the disclosure.

SUMMARY

Movement of displayed contents or screen movement may occur on a display of each of various electronic devices of the related art under control of a processor. Meanwhile, because the display implements a screen by sequentially providing gate signals to a plurality of gate lines, a data update time for each gate line may vary. Thus, when a screen moves on the display of the related art and when a direction where the screen is moved is not identical to a gate scan direction, there is a visual problem (e.g., smooth pursuit) in which arranged images or texts are not seen as being horizontally moved and are seen as being moved in an inclined state.

Aspects of the disclosure are to address at least the above-mentioned problems and/or disadvantages and to provide at least the advantages described below. Accordingly, an aspect of the disclosure is to provide a method for compensating for screen movement of a display for naturally displaying screen movement by compensating for an image or text output state according to a movement speed when screen movement occurs on the display and an electronic device for supporting the same.

Additional aspects will be set forth in part in the description which follows and, in part, will be apparent from the description, or may be learned by practice of the presented embodiments.

In accordance with an aspect of the disclosure, an electronic device is provided. The electronic device includes a display configured to output a screen and a processor operatively connected to the display. The processor is configured to receive a user input associated with movement of a screen output on the display, detect a screen movement speed corresponding to an input associated with the screen movement, and differently determine an amount of tilt compensation of at least some screen regions according to the screen movement, according to the screen movement speed.

In accordance with another aspect of the disclosure, a method for compensating for screen movement of a display is provided. The method includes outputting a screen on the display, receiving a user input, determining whether a screen movement direction corresponding to the user input is identical to a gate scan direction when the user input is an input associated with screen movement, detecting a screen movement speed corresponding to the input associated with the screen movement when the screen movement direction is not identical to the gate scan direction, and differently determining a compensation value associated with a degree to whether a current screen frame is inclined, according to the screen movement speed.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
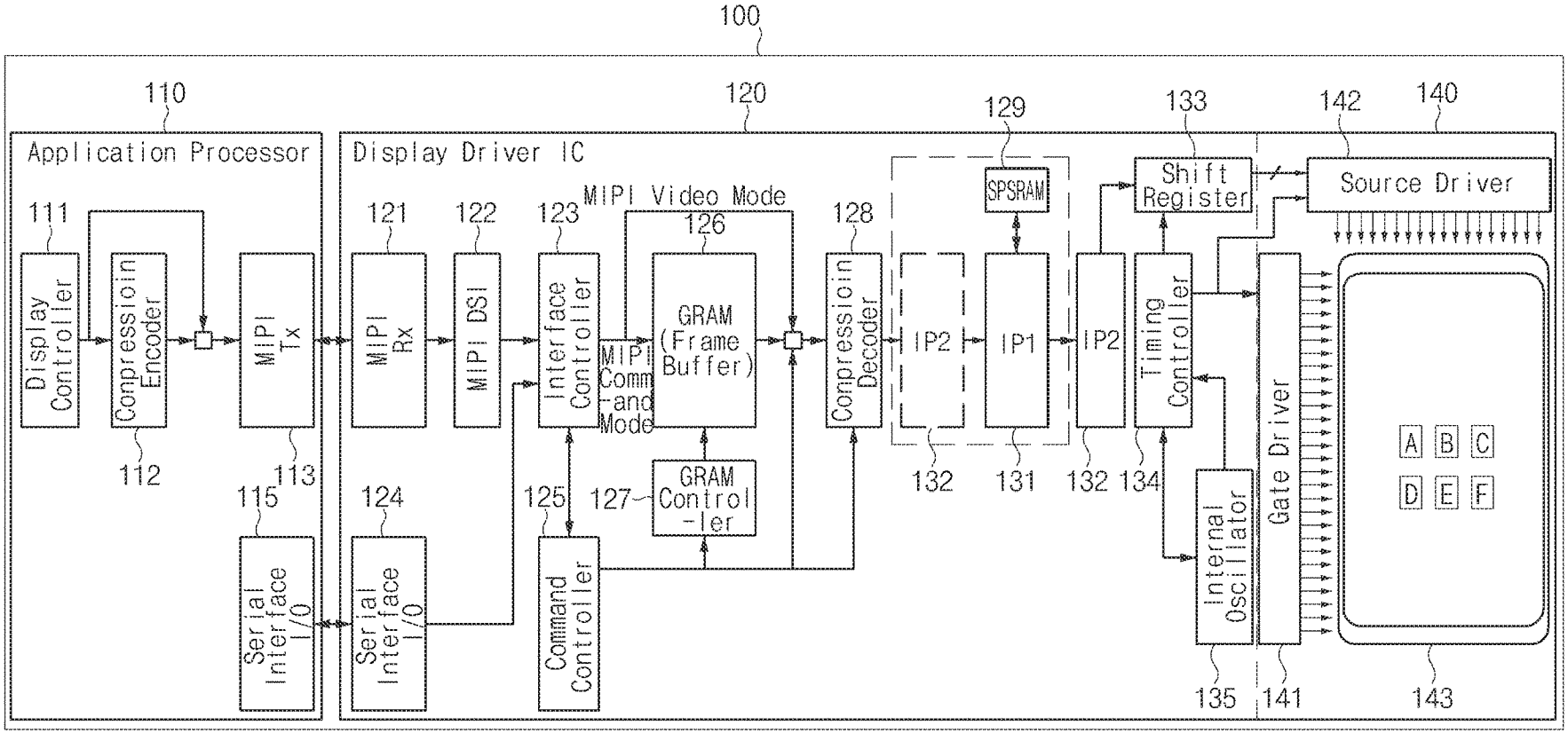
FIG. 1 is a drawing illustrating some components of an electronic device for supporting compensation of screen movement according to an embodiment of the disclosure.

FIG. 1 is a drawing illustrating some components of an electronic device for supporting compensation of screen movement according to an embodiment of the disclosure.

Referring to FIG. 1, an electronic device 100 according to an embodiment may include a processor 110, a display driver integrated circuit (IC) (DDI) 120, and a display 140.

The processor 110 (e.g., an application processor, a communication processor, a sensor hub, a touch screen panel (TSP) IC, or the like) may generate display data according to various embodiments and may provide the DDI 120 with the generated display data (e.g., data configuring a screen including at least one of an image or a text). For example, the processor 110 may encode or compress display data in a specified manner and may provide the DDI 120 with the encoded or compressed display data. For example, upon execution of screen movement, the processor 110 may process compensation (e.g., data transformation for a jelly scroll phenomenon) associated with the screen movement. In this regard, the processor 110 may include a display controller 111, a compression encoder 112, an internal transmit interface 113 (e.g., a mobile industry processor interface (MIPI) Tx), and a first serial interface 115.

The display controller 111 may generate display data to be delivered to the DDI 120, based on data delivered by a central processing unit/graphic processing unit (CPU/GPU).

The compression encoder 112 may encode display data, generated by the display controller 111, in a specified manner (e.g., a display stream compression (DSC) scheme determined by the video electronics standards association (VESA)). As a result, the display data generated by the display controller 111 may be compressed to decrease in data size. For example, the display data generated by the display controller 111 may decrease in size to 1/n by encoding of the compression encoder 112. According to various embodiments, the compression encoder 112 may be omitted. In other words, the display data may be delivered to the DDI 120 without the compression process.

The internal transmit interface 113 may deliver the display data encoded by the compression encoder 112 to the DDI 120. The internal transmit interface 113 may include a mobile industry processor interface (MIPI).

The processor 110 may perform data processing associated with compensating for screen movement. According to an embodiment, when display data is output, the processor 110 may determine whether a gate scan direction (a direction formed as scan signals are sequentially output from a gate driver) is identical to a screen movement direction (a direction where a screen is moved by a scroll operation). In this regard, the processor 110 may obtain at least one of configuration information about a content display direction (e.g., information configured to be output in a horizontal or vertical direction of the electronic device 100 when content is output, depending on a user setting, or information configured to change a content display direction depending on rotation of the electronic device 100) and information about a direction where the electronic device 100 is located (e.g., sensor information of an acceleration sensor). The processor 110 may compare the gate scan direction with the screen movement direction based on the obtained information.

When the gate scan direction differs from the screen movement direction, the processor 110 may calculate a compensation value associated with compensating for screen movement, may apply the compensation value, and may deliver an image to which the compensation value is applied (e.g., to the DDI 120). In this operation, the processor 110 may receive a touch input signal from a touch circuitry (not shown), may identify occurrence of an input (e.g., a scroll input) associated with screen movement, and may detect a movement speed (or a scroll speed) associated with the input associated with the screen movement.

According to an embodiment, when an operation of determining whether the gate scan direction and the screen movement direction are the same as each other and operations of detecting a screen movement speed, calculating a compensation value, and applying the compensation value, when the directions are not the same as each other, are designed to be performed by the DDI 120, the processor 110 may deliver content display direction configuration information to the DDI 120. According to an embodiment, the processor 110 may deliver sensor information associated with a state where the electronic device 100 is located, which is obtained by an acceleration sensor (not shown), to the DDI 120. According to various embodiment, at least some of operations of detecting a screen movement speed, calculating a compensation value, and applying the compensation value may be designed to be performed by the processor 110 (e.g., the application processor), and at least the other of the operations may be designed to be performed by the DDI 120.

According to various embodiments, a sensor hub (or a sensor control processor) associated with operating a sensor of the electronic device 100 is located in the electronic device 100, and the electronic device 100 may include a signal line which is directly connected between the sensor hub and the DDI 120. In this case, the function of delivering sensor information of the processor 110 may be omitted, and the sensor information may be delivered by the sensor hub. The information delivered by the sensor hub may include at least one of a touch input signal of the touch circuitry and sensor information associated with the state where the electronic device 100 is located.

The processor 110 may deliver a control signal to the DDI 120 via the first serial interface 115. For example, the processor 110 may receive a touch input signal from the touch circuitry and may deliver the received touch input signal to the DDI 120 via the first serial interface 115. According to various embodiments, the processor 110 may collect a sensor signal of at least one sensor (e.g., an acceleration sensor for sensing the state where the electronic device 100 is located) included in the electronic device 100 and may deliver the collected sensor signal to the DDI 120 via the first serial interface 115. Alternatively, the processor 110 may deliver information, about a screen movement speed received from the touch circuitry, the state where the electronic device 100 is located, which is determined based on a sensor signal, or a gate scan direction, to the DDI 120 via the first serial interface 115.

The DDI 120 may calculate and apply a color transform value of display data depending on settings and may output the display data to the display panel 143. When the processor 110 is designed to perform compensation processing associated with operating screen movement and calculate and apply a compensation value, the DDI 120 may play a role in receiving display data to which the compensation value is applied according to screen movement from the processor 110 and outputting the display data to the display panel 143. According to various embodiments, when the DDI 120 is designed to perform compensation processing associated with operating screen movement, it may detect a screen movement speed when receiving display data from the processor 110, may generate compensated data in response to the detected screen movement speed, and may output the generated compensation data on the display 140.

According to various embodiments, the DDI 120 may set a region of interest (ROI) prior to detecting a screen movement speed. Alternatively, the DDI 120 may compare a screen movement speed with a predefined compensation application range value to determine whether to generate compensate data. According to various embodiments, when the processor 110 also detects a screen movement speed and delivers a screen movement speed value to the DDI 120 in conjunction with compensating for screen movement, the DDI 120 may calculate a compensation value depending on the received screen movement speed value and may output display data to which the compensation value is applied.

The DDI 120 may include the internal receive interface 121 (e.g., the MIPI Rx), a MIPI display serial interface (DSI) 122, an interface controller 123, a second serial interface 124, a command controller 125, a first memory 126 (e.g., a graphic RAM (GRAM)), a memory controller 127 (e.g., a GRAM controller), a compression decoder 128, a second memory 129 (e.g., a single port static RAM (SPSRAM)), a first internal processing module (IP1) 131, a second internal processing module (IP2) 132, a shift register 133, a display timing controller 134, and an internal oscillator 135.

The internal receive interface 121 may communicate with the processor 110 to receive control information and display data from the processor 110. The internal receive interface 121 may include, for example, a MIPI receiver circuit. When receiving control information and display data via an internal transmit interface (a MIPI transmitter circuit) of the processor 110, the internal receive interface 121 may deliver the control information and the display data to the interface controller 123 via the MIPI DSI 122. The MIPI DSI 122 may be a component capable of being added when the internal receive interface 121 is designed to process data of a MIPI mode, which may be omitted or may be replaced with another component, when the internal transmit interface 113 and the internal receive interface 121 are changed.

The interface controller 123 may receive display data and/or control information from the processor 110. The interface controller 123 may deliver the received display data to the memory controller 127. The interface controller 123 may deliver the received control information to the command controller 125. According to an embodiment, the interface controller 123 may receive sensor information via the second serial interface 124. For example, the interface controller 123 may receive screen movement information collected by the touch circuitry or sensor information associated with the state where the electronic device 100 is located via the second serial interface 124 and may deliver the screen movement information and the sensor information to the command controller 125.

The memory controller 127 may write the display data received from the interface controller 123 on the first memory 126. For example, the memory controller 127 may write the display data on the first memory 126 depending on a frame rate of the display data delivered by the processor 110.

The first memory 126 may include a GRAM. The first memory 126 may store display data delivered by the memory controller 127. The stored display data may include display data in a state where it is compressed or is not compressed by the processor 110. The first memory 126 may include a memory space corresponding to resolution of the display panel 143 and/or the number of color gradations of the display panel 143. The first memory 126 may include a frame buffer, a line buffer, or the like. The first memory 126 may vary in the number of updates or in speed according to a type of an image output to the display panel 143. For example, when a moving image is played, display data corresponding to a frame of the moving image may be written at a specified speed on the first memory 126. For an image (e.g., a still image), the first memory 126 may store a previous image until the image is updated. The display data stored in the first memory 126 may include a coordinate value to be displayed on each display region of the display 140, or an order of the display data may correspond to coordinates to be displayed on the display 140.

The command controller 125 may apply a color transform value corresponding to the display data stored in the first memory 126 to control the display timing controller 134 to output the display data on a specified region of the display panel 143. The command controller 125 may be referred to as a control logic. When at least a portion of display data read from the first memory 126 is encoded, the compression decoder 128 may decode the at least a portion of the display data in a specified manner and may deliver the decoded data to the display timing controller 134. For example, when the size of the display data is compressed to 1/n by the compression encoder 112 of the processor 110, the compression decoder 128 may decompress the at least a portion of the display data to restore the display data to the display data before the compression. The first internal processing module 131 and the second internal processing modules 132 (e.g., an up-scaler and/or an image pre-processing unit) may be located between the compression decoder 128 and the display timing controller 134. According to various embodiments, when the at least a portion of the display data selected by the command controller 125 is not encoded, the compression decoder 128 may be omitted or bypassed.

The first internal processing module 131 may perform data calculation and display data processing, which are associated with processing screen movement. For example, the first internal processing module 131 may obtain and store (e.g., in the second memory 129) at least a portion (e.g., diagonal pixel information crossing some regions of a screen) of display data read from the first memory 126 and may detect a screen movement speed based on a change in the at least a portion of the display data. When the screen movement speed is detected, the first internal processing module 131 may calculate a compensation value to be applied to display data in conjunction with the screen movement speed and may generate compensation data by applying the calculated compensation value to each of the display data. The first internal processing module 131 may store the compensation data to which the compensation value is applied in the second memory 129 and may then deliver the compensation data to the second internal processing module 132. According to various embodiments, the first internal processing module 131 may calculate an ROI based on the display data. For example, the first internal processing module 131 may detect a change in display data using the second memory 129 and may detect an ROI based on the change in display data. The first internal processing module 131 may detect a screen movement speed in the detected ROI and may calculate and apply a compensation value to be applied to the ROI. The first internal processing module 131 may be implemented as a software module capable of processing the above-mentioned compensation associated with the screen movement to be loaded or may be provided as a separate hardware processor capable of processing the compensation associated with the screen movement to be disposed in at least one of the inside and the outside of the DDI 120.

The second internal processing module 132 may be implemented as a hardware processor capable of processing a function of a scaler or an image pre-processing unit or may be provided in the form of a software block to be loaded into the DDI 120. The second internal processing module 132 may perform an up-scaler function of scaling up the decompressed image at a specified magnification. According to an embodiment, when it is necessary to scale up display data depending on a size of the display data to be output on the display panel 143 or depending on a user setting, the second internal processing module 132 may scale up the display data. The scaled-up display data may be delivered to the display timing controller 134. When at least a portion of the display data is not required to be scaled up, the up-scaler function of the second internal processing module 132 may be omitted or bypassed. The second internal processing module 132 may perform a function of a pre-processing unit for enhancing image quality of display data. The second internal processing module 132 may include, for example, a pixel data processing circuit, a pre-processing circuit, a gating circuitry, and the like.

The display timing controller 134 may control timings of components included in the DDI 120. For example, the display timing controller 134 may adjust a timing for storing display data received from the processor 110 in the first memory 126 and a timing for reading display data stored in the first memory 126 not to be overlapped with each other. The display timing controller 134 may control a timing for reading display data stored in the first memory 126 at a specified frame rate in response to control of the command controller 125 and delivering the display data to the compression decoder 128, the first internal processing module 131, and the second internal processing module 132.

The display timing controller 134 may deliver display data, received from the second internal processing module 132, to a source driver 142 in response to control of the command controller 125 and may control to output a gate signal of a gate driver 141. According to an embodiment, the display timing controller 134 may be implemented to be included in the command controller 125. The display timing controller 134 may convert display data received from the first memory 126 or the second memory 129 via the second internal processing module 132 into an image signal and may provide the image signal to the source driver 142 and the gate driver 141 of the display panel 143.

The shift register 133 may receive the data processed by the second internal processing module 132 and may deliver the received data to the source driver 142 under control of the display timing controller 134. The internal oscillator 135 may generate a timing signal necessary to operate the display timing controller 134 and may deliver the generated timing signal to the display timing controller 134.

The display 140 may include the source driver 142, the gate driver 141, and the display panel 143. In addition, the display 140 may further include a touch panel and a touch IC associated with a user input, a pressure sensor and a pressure sensor IC, a digitizer, or the like.

The display panel 143 may display a variety of information (e.g., information including at least one of multimedia data or text data) to a user. The display panel 143 may include, for example, a liquid-crystal display (LCD) panel, an active-matrix organic light-emitting diode (AM-OLED) panel, or the like. The display panel 143 may be implemented to be, for example, flexible, transparent, or wearable. Furthermore, the display panel 143 may be included in, for example, a cover of a case electrically combined with the electronic device 100.

The display panel 143 may receive an image signal corresponding to display data from the DDI 120 and may display a screen according to the display data. A plurality of data lines and a plurality of gate lines may intersect each other on the display panel 143, and a plurality of pixels may be disposed in the intersecting region. When the display panel 143 corresponds to an OLED panel, each of the plurality of pixels may include at least one or more switching elements (e.g., FETs) and one OLED. Each pixel may receive an image signal or the like from the DDI 120 at a certain timing to generate light. The display panel 143 may have, for example, specific resolution (e.g., resolution of 1536 (horizontal)×2152 (vertical))

Each of the source driver 142 and the gate driver 141 may generate signals provided to a scan line and a data line of the display panel 142, which are not shown, based on a source control signal and a gate control signal received from the display timing controller 134.

Figure 2:
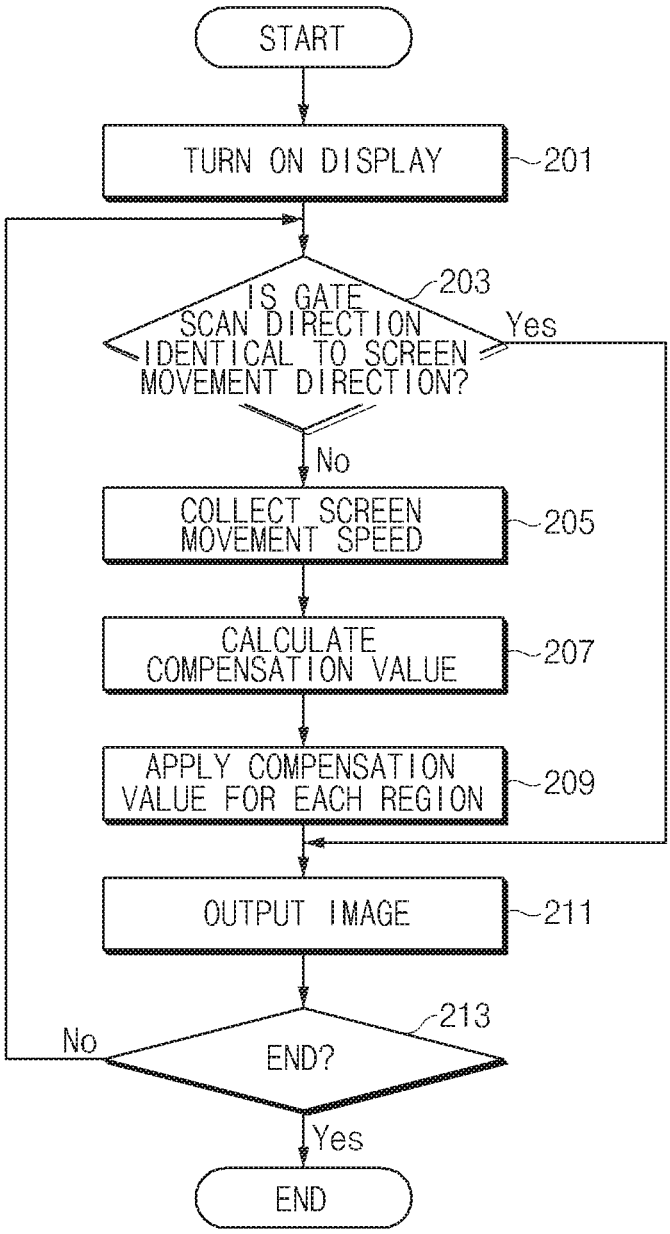
FIG. 2 is a flowchart illustrating an example of a method for compensating for screen movement of a display according to an embodiment of the disclosure.

FIG. 2 is a flowchart illustrating an example of a method for compensating for screen movement of a display according to an embodiment of the disclosure.

Referring to FIG. 2, in the method for compensating for screen movement according to an embodiment, in operation 201, a processor 110 (or at least one of an AP and a DDI 120) of an electronic device 100 of FIG. 1 may turn on a display 140 of FIG. 1 depending on a user input or a predetermined system setting. After the display 140 is turned on, the processor 110 may control to process various predetermined functions. For example, the display 140 may output an idle screen, may output a specific webpage depending on a user input, or may output a picture search screen including a plurality of thumbnail images depending on execution of a gallery function. Alternatively, the display 140 may output a screen, at least a portion of which is composed of text. According to various embodiments, the display 140 may output a screen including a plurality of divided screens, each of which includes different information, or may overlap or overlay and display a window (e.g., a video pop-up window or a notification pop-up window), which displays second information with a screen (e.g., a screen including at least some texts) where first information is displayed in the background, on the screen where the first information is displayed.

When the input associated with the screen movement is received, in operation 203, the processor 110 (or at least one of an AP and a DDI 120) may determine whether a gate scan direction and a scroll direction of the display 140 are the same as each other. In conjunction with the input associated with the screen movement, the electronic device 100 may include a touch circuitry composed of a touch screen (or a touch panel) and a touch IC for driving the touch screen (or the touch panel). When receiving the input associated with the screen movement through the touch screen, the processor 110 may identify a direction of the screen movement and may compare the screen movement direction with the gate scan direction. In this regard, the processor 110 may identify at least one of configuration information about a content display direction (e.g., configuration information to be displayed in a horizontal or vertical direction when content is displayed or configuration information to change the content display direction to the horizontal or vertical direction depending on a direction where the electronic device 100 is located) and a state where the electronic device 100 is located.

In conjunction with identifying the state where the electronic device 100 is located, the processor 110 may identify whether there is a setting for being displayed in only the horizontal direction when content is displayed or there is a setting for being displayed in only the vertical direction when the content is displayed. Alternatively, the processor 110 of the electronic device 100 may determine whether a change in horizontal or vertical display according to the direction where the electronic device 100 is located is set. When a content display direction is set to be changed according to an arrangement direction, the processor 110 of the electronic device 100 may obtain sensor information and may identify a state where the electronic device 100 is located. In this regard, the electronic device 100 may include a gyro sensor or an acceleration sensor and may identify a gate scan direction based on collected sensor information.

The gate scan direction may be a direction where gate signals are sequentially input to a plurality of gate signal lines constituting the display 140. Because a state where the gate signal lines of the display 140 are arranged is fixed, when content display is set to change in a horizontal or vertical direction according to a change in arrangement of the electronic device 100, the gate scan direction may be determined according to a state where the electronic device 100 is located. For example, the gate scan direction may be determined from the left to the right, from the right to the left, from the top to the bottom, or from the bottom to the top, according to a direction where the electronic device 100 is disposed.

When the gate scan direction is not the same as the scroll direction, in operation 205, the processor 110 (e.g., at least one of an AP or the DDI 120 of the electronic device 100) may collect a screen movement speed. In this regard, the processor 110 may detect a pixel change according to movement of a screen output on the display 140 and may calculate a screen movement speed depending on the pixel change. According to various embodiments, the processor 110 may calculate a scroll speed using touch coordinates transmitted from the touch circuitry. Alternatively, the processor 110 may detect a change in a partial region of a screen output on the display 140 and may calculate a screen movement speed according to the detected change. According to various embodiments, the processor 110 may collect a screen movement speed from the touch circuitry which provides the input associated with the screen movement. The screen movement speed may include, for example, a pixel change rate per frame. When the gate scan direction is the same as the scroll direction, in operation 211, the processor 110 may output data stored in a frame buffer on the display 140 without separate compensation associated with the screen movement.

In operation 207, the processor 110 (e.g., at least one of the AP or the DDI 120 of the electronic device 100) may calculate a compensation value (or the amount of screen tilt compensation) to be applied to display data to be output according to a screen movement speed. In this operation, the processor 110 may vary a level of the compensation value (or the amount of compensation) depending on the screen movement speed. According to an embodiment, the processor 110 may calculate a compensation value where the number of equal parts dividing the display 140 is increased as the screen movement speed is increased. According to an embodiment, the processor 110 may calculate a compensation value where the number of equal parts dividing the display 140 is decreased as the screen movement speed is decreased. According to various embodiments, the processor 110 may vary a size of a region for changing data, on each of screen regions equally divided according to a screen movement speed. For example, the processor 110 may equally divide a screen into several columns in a first direction (e.g., a horizontal direction) depending to a screen movement speed. The processor 110 may divide a screen region equally divided into each column into a plurality of regions in a second direction (e.g., a horizontal direction) and may determine a region to change data. According to various embodiments, when the screen movement speed is included in a specified first interval (or a first time range), the processor 110 (or the DDI 120) may determine the amount of screen tilt compensation according to the screen movement based on the screen movement speed (the amount of compensating for a state where at least a portion of the screen is inclined to be horizontally seen). Alternatively, when the screen movement speed is included in a second interval (or a second time range) faster than the first interval, the processor 110 (or the DDI 120) may set the amount of screen tilt compensation based on the screen movement speed to be kept constant.

In operation 209, the processor 110 (e.g., at least one of the AP or the DDI 120 of the electronic device 100) may apply compensation for each equally divided region to display data to be output. According to an embodiment, with respect to respective regions of a screen equally divided to include a plurality of columns, the processor 110 may vertically divide each of the regions into three regions, may add data to the first region (e.g., a data copy region), may maintain original data on the second region (e.g., a data shift region) to move a location of the original data, and may remove data from the third region (e.g., a data truncation region) to generate compensation data for screen movement. In this operation, the processor 110 may assign a first region or a third region of sub-regions of the display 140, which are adjacent to a region to which a gate signal is relatively first input among equally divided regions to be larger (or smaller) in size than a first region or a third region of sub-regions to which the gate signal is input relatively later. According to various embodiments, as going from a sub-region adjacent to a region to which a gate signal is relatively first input among equally divided regions to sub-regions being away from the region, the processor 110 may generate compensation data where a first region (or a third region) of the respective sub-regions is assigned to be gradually larger (or smaller) in size. According to various embodiments, as going from a sub-region adjacent to a region to which a gate signal is relatively first input among equally divided regions to sub-regions being away from the region, the processor 110 may gradually increase the amount of additional data to be added to a data copy region of the respective sub-regions (or remove data by the same amount as added data increases). According to various embodiments, as going from a sub-region adjacent to a region to which a gate signal is relatively first input among equally divided regions to sub-regions being away from the region, processor 110 may gradually increase the amount of candidate data to be removed from a data truncation region of the respective sub-regions. According to various embodiments, when the amount of screen tilt compensation based on a screen movement speed is kept constant, the processor 110 (or the DDI 120) may set the amount of compensation (or the amount of screen tilt compensation) to 0 or a specific value (e.g., a pixel/frame of a specific speed). According to various embodiments, when the screen movement speed is included in a third interval (or a third time range) faster than the second interval, the processor 110 (or the DDI 120) may set the amount of screen tilt compensation according to the screen movement based on the screen movement speed to 0. Alternatively, when the screen movement speed is included in an interval relatively slower than the first interval, the processor 110 (or the DDI 120) may set the amount of screen tilt compensation according to the screen movement based on the screen movement speed to 0.

According to various embodiments, when determining the amount of screen tilt compensation according to the screen movement based on the screen movement speed, the processor 110 (or the DDI 120) may change the amount of compensation according to the screen movement speed in a linear or non-linear manner. The non-linear change may include, for example, a stepwise change, a change in exponential function or logarithmic function, or the like.

In operation 211, the processor 110 (e.g., at least one of the AP or the DDI 120 of the electronic device 100) may output display data to which compensation for each equally divided region is applied on the display 140. While the screen is moved in a screen movement direction, at least a portion of the screen may be output to be seen as being horizontally moved without being tilted, as display data to which compensation is applied is output.

In operation 213, the processor 110 (at least one of the AP or the DDI 120) may determine whether an input signal associated with ending the screen output is received. When there is no input signal associated with ending the screen output, the processor 110 may branch to operation 203 to perform the operation from operation 203 again.

In the above-mentioned description, at least one of the operation of determining whether the gate scan direction is the same as the screen movement direction, the operation of detecting a screen movement speed when the directions are not the same as each other, the operation of calculating a compensation value, or the operation of generating data (e.g., display data) to which the compensation value is applied may be performed by the processor 110 or the DDI 120. For example, the processor 110 may perform all of the operation of determining whether the gate scan direction is the same as the screen movement direction, the operation of detecting the screen movement speed when the directions are not the same as each other, the operation of calculating the compensation value, or the operation of generating data (e.g., display data) to which the compensation value is applied. In this case, the DDI 120 may receive the display data to which the compensation value is applied and may output the display data on the display panel 143.

According to various embodiments, the processor 110 may perform only the operation of determining whether the gate scan direction is the same as the screen movement direction and the operation of detecting a screen movement speed when the directions are not the same as each other. In this case, the DDI 120 may calculate a compensation value according to a screen movement speed, may generate display data to which the compensation value is applied, and may output the display data.

According to various embodiments, the processor 110 may perform only the operation of determining whether the gate scan direction is the same as the screen movement direction, the operation of detecting a screen movement speed when the directions are not the same as each other, and the operation of calculating a compensation value. In this case, the DDI 120 may receive the calculated compensation value and may generate and output compensation data according to the compensation value.

Figure 3:
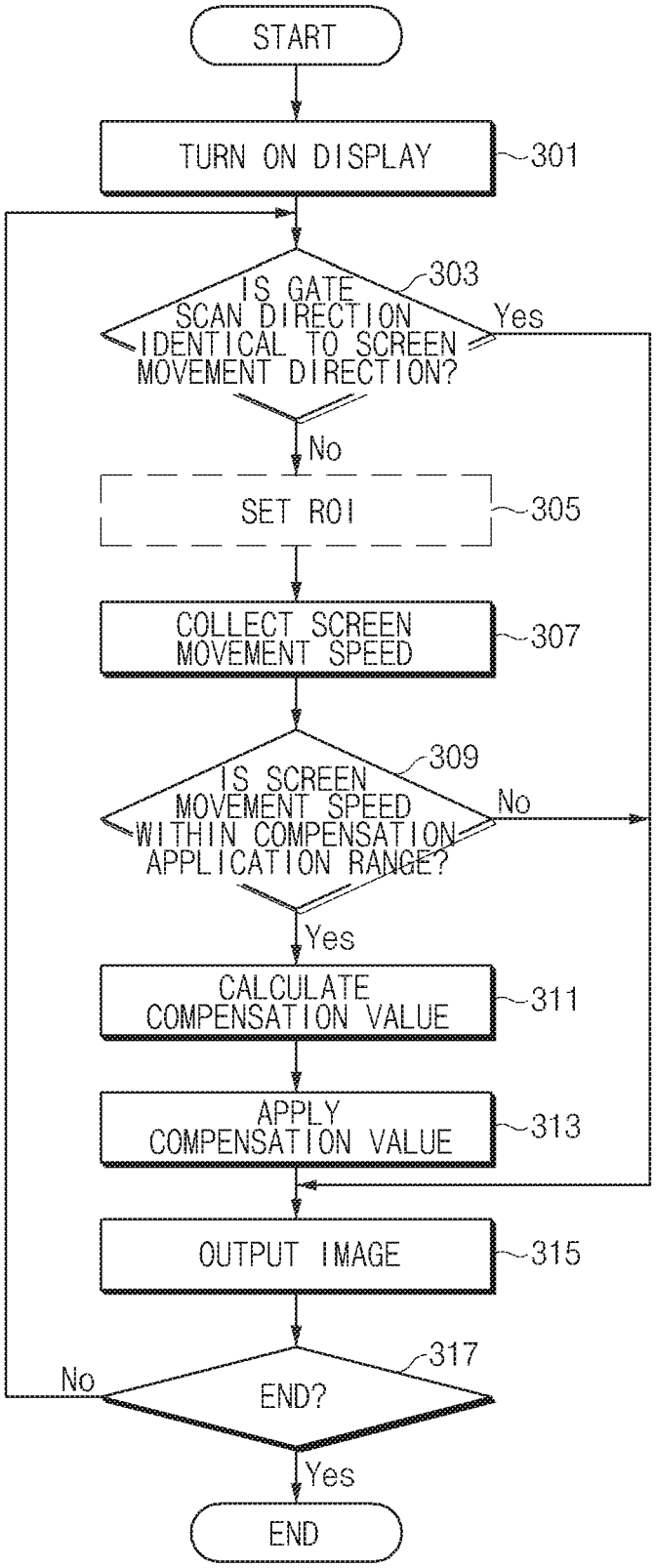
FIG. 3 is a flowchart illustrating another example of a method for compensating for screen movement of a display according to an embodiment of the disclosure.

FIG. 3 is a flowchart illustrating another example of a method for compensating for screen movement of a display according to an embodiment of the disclosure.

Referring to FIG. 3, in the method for compensating for screen movement according to an embodiment, in operation 301, a processor 110 (or at least one of an AP and a DDI 120) of an electronic device 100 of FIG. 1 may turn on a display 140 of FIG. 1 depending on a user input or predetermined information. Performing the function according to the turn-on of the display 140 may be the same as or similar to operation 201 described above.

When an input associated with screen movement is received, in operation 303, the processor 110 (or at least one of an AP and a DDI 120) may determine whether a gate scan direction and a scroll direction of the display 140 are the same as each other. In conjunction with the input associated with the screen movement, as described above, the processor 110 may receive the input associated with the screen movement from a touch circuitry included in the electronic device 100. The processor 110 may compare a scan direction where a signal is provided to gate lines with the screen movement direction.

When the gate scan direction and the scroll direction are not the same as each other, in operation 305, the processor 110 (or the DDI 120) may set an ROI. In conjunction with setting the ROI, the processor 110 may identify the ROI according to the user input. According to various embodiments, the processor 110 may detect a screen change from a screen which is currently outputting on the display 140 and may set a region, where the detected screen change rate is greater than or equal to a specified value, as the ROI. Alternatively, the processor 110 may identify configuration information of the screen which is currently outputting (e.g., configuration information defining whether each region of a webpage is any region) and may set a specified partial region of the screen as the ROI based on the screen configuration information. According to various embodiments, the operation of setting the ROI may be omitted.

In operation 307, the processor 110 (e.g., at least one of the AP or the DDI 120 of the electronic device 100) may collect a screen movement speed. When the ROI is set in operation 305, in operation 307, the processor 110 (e.g., at least one of the AP or the DDI 120) may collect the screen movement speed in the ROI. For example, the processor 110 may detect changes in locations of at least some pixels of the ROI and may collect a screen movement speed based on the detected changes. According to various embodiments, the processor 110 may perform the calculation of the screen change rate and the calculation of the screen movement speed in the same manner or in a similar manner. Alternatively, the processor 110 may use the result of calculating the screen change rate as the screen movement speed. According to various embodiments, the processor 110 may perform the operation of calculating the screen change rate and the operation of calculating the screen movement speed in any order. For example, after calculating the screen movement speed, the processor 110 may apply the screen change rate for detecting (or setting) an ROI (e.g., set a region where the screen change rate is greater than or equal to a certain rate to the ROI). In this operation, the processor 110 may use the result of calculating the screen movement speed to set the ROI. Alternatively, after setting the ROI by detecting the region where the screen change rate is greater than or equal to the certain rate, the processor 110 may calculate the screen movement speed for the set ROI. When operation 305 is omitted, the processor 110 may detect changes in pixels of at least some regions of the screen and may calculate a screen movement speed like operation 205 of FIG. 2. According to various embodiments, in conjunction with calculating the screen movement speed, the processor 110 may calculate the screen movement speed based on at least one of a drag speed, a fling speed, or a scroll speed of a user input. Alternatively, the processor 110 may calculate the screen movement speed based on a change in user touch input.

In operation 309, the processor 110 (e.g., at least one of the AP or the DDI 120 of the electronic device 100) may determine whether the calculated screen movement speed is within a compensation application range. A limit value for determining whether the screen movement speed is within the compensation application range may be determined by various statistics or experiments. For example, the limit value for the compensation application range may be set to a limit value where it is possible for eyes of a user to feel changes while tracking screen changes. The electronic device 100 may store and operate the limit value for the compensation application range in a separate memory or in a first memory 126 or a second memory 129 of the DDI 120. When the screen movement speed departs from the compensation application range, for example, when a degree of change according to screen movement on the screen is quick enough not to be recognized by eyes of the user or when a screen change by a scroll operation is slower than a gate scan speed, the processor 110 may omit operations below and may branch to operation 315 to output display data stored in a frame buffer (or the first memory 126).

When the screen movement speed is within the compensation application range, in operation 311, the processor 110 (e.g., at least one of the AP or the DDI 120 of the electronic device 100) may calculate a compensation value of display data to be output according to the screen movement speed. According to an embodiment, when the detected screen movement speed is quicker than a specified first screen movement speed and is slower than a specified second screen movement speed (e.g., when the detected screen movement speed is greater than or equal to the first screen movement speed and is less than the second screen movement speed), the processor 110 may increase a compensation value in a linear manner depending on the screen movement speed. For example, like operation 207 describe above, the processor 110 may differently adjust the number of equal parts of the display 140 depending on the screen movement speed, may calculate a compensation value to differently have a rate of increase of the number of a certain amount of data to be applied to a data copy region or a rate of increase of the number of candidate data (or removal data) to be removed from a data truncation region on equally divided regions, or may calculate a compensation value to differently adjust a size of the data copy region or the data truncation region (e.g., the number of pixel lines).

According to various embodiments, when the ROI is set, the processor 110 (e.g., at least one of the AP or the DDI 120) may calculate a compensation value of display data according to a screen movement speed, with respect to the ROI. When the detected screen movement speed is greater than or equal to the second screen movement speed, the processor 110 may calculated a fixed compensation value.

In operation 313, the processor 110 (e.g., at least one of the AP or the DDI 120 of the electronic device 100) may apply a compensation value for each region to display data to be output. For example, like operation 209 above of FIG. 2, the processor 110 may equally divide the screen into a certain number of columns according to a compensation value in a first direction and may add data to some regions or may delete data from the other regions in a second direction (e.g., a direction perpendicular to the first direction) with respect to the equally divided respective columns to generate compensation data. In this operation, when the ROI is set, the processor 110 may fix a region around the ROI and may process a screen update where the compensation value is applied to only the ROI.

In operation 315, the processor 110 (e.g., at least one of the AP or the DDI 120 of the electronic device 100) may output display data, to which the compensation value for each region is applied, on the display 140. Thereafter, in operation 317, the processor 110 may determine whether an input signal associated with ending the screen output is received. When there is no input signal associated with ending the screen output, the processor 110 may branch to operation 303 to perform the operation from operation 203 again.

Figure 4:
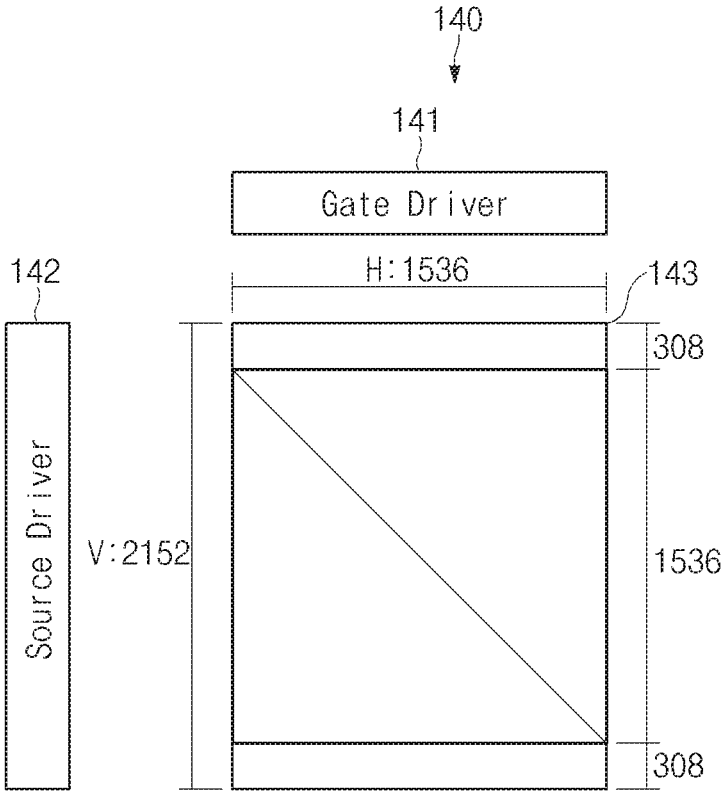
FIG. 4 is an illustration of display settings associated with detecting a screen movement speed according to an embodiment of the disclosure.
Figure 5:
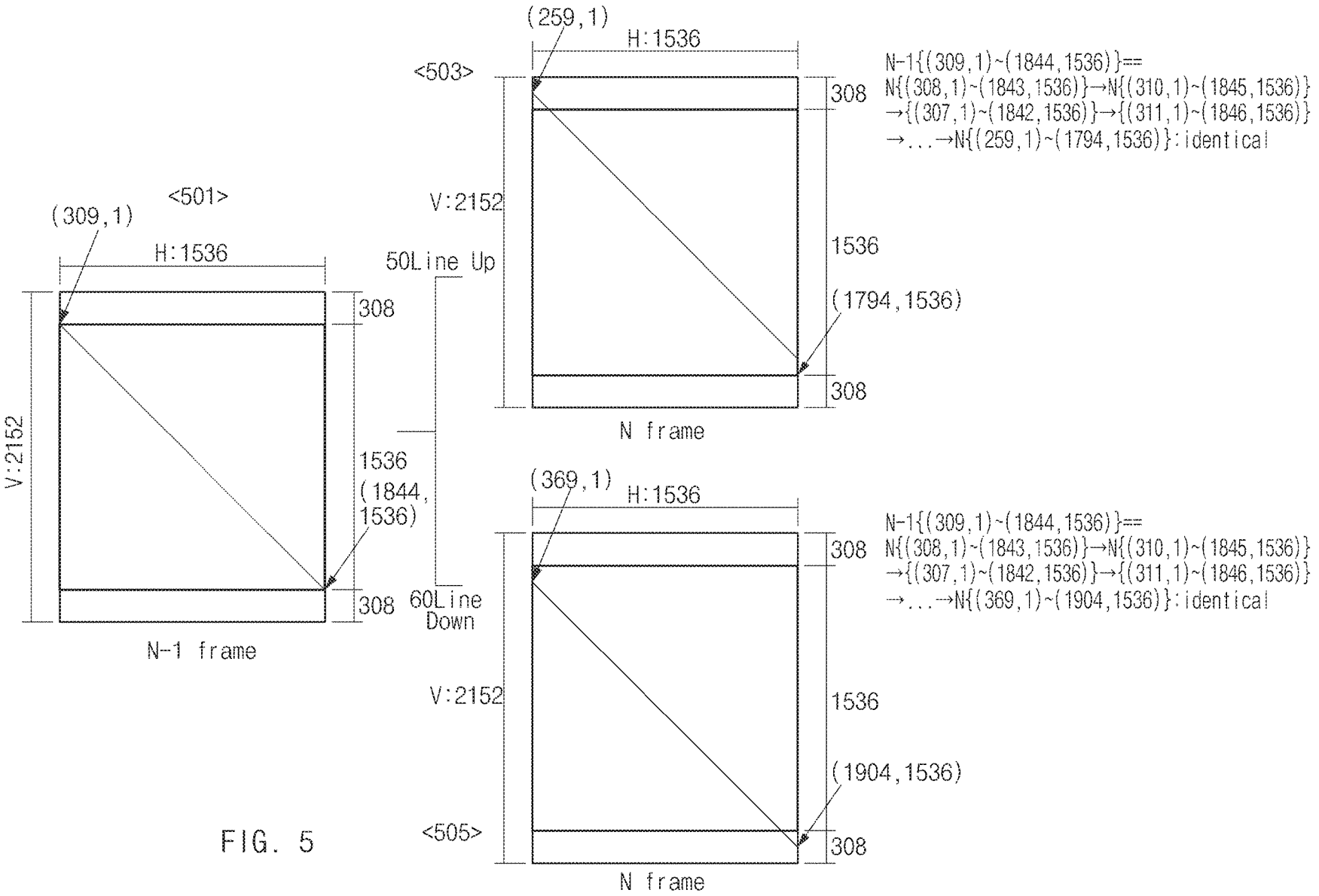
FIG. 5 is an illustration of an example of a method for detecting a screen movement speed according to an embodiment of the disclosure.

FIG. 4 is a drawing illustrating display settings associated with detecting a screen movement speed according to an embodiment of the disclosure. FIG. 5 is a drawing illustrating an example of a method for detecting a screen movement speed according to an embodiment of the disclosure.

Referring to FIGS. 4 and 5, a display 140 may include a display panel 143, a gate driver 141, and a source driver 142. As described above, the display panel 143 may include gate signal lines (e.g., H: 1536) connected with the gate driver 141 and source signal lines (e.g., V: 2152) connected with the source driver 142. A DDI 120 (or the processor 110) of the electronic device 100 may detect a change in at least a portion of data (or display data, a screen, or an image) output on the display panel 143 to detect a screen movement speed. For example, as shown, the DDI 120 may detect a change in information of pixels located on a diagonal of at least a portion of the display panel 143 to detect a screen movement speed.

Because a probability that diagonal pixels will be changed is higher than a probability that specific horizontal line pixels will be changed or that specific vertical line pixels will be changed while a screen is changed according to screen movement, the DDI 120 may set a diagonal for at least a portion of the display panel 143. The DDI 120 may store and compare pixel information of each diagonal on a frame-by-frame basis. Alternatively, the DDI 120 may obtain diagonal pixel information items from a frame at a time when an input associated with screen movement occurs. When a screen is moved according to the input associated with the screen movement, the DDI 120 may detect movement of diagonal pixels and may calculate a movement distance according to the input associated with the screen movement to determine a screen movement speed.

In conjunction with setting the diagonal, the DDI 120 may set a central region (e.g., source lines 309 to 1844 and gate lines 1 to 1536), except for upper some regions (e.g., source lines 1 to 308) and lower some regions (e.g., lines 1845 to 2152) of the display panel 143, and may set a diagonal connecting vertices of the central region.

In conjunction with setting the central region, for a webpage, statistically, the upper some regions and the lower some regions may be fixed (may frequently be fixed) in information and may be regions (or may frequently be composed of regions) set not to be scrolled although there is an input associated with screen movement. Thus, when a corresponding region is excluded from a diagonal setting region associated with detecting screen movement speed, diagonals may be reduced in length. As a result, the operation of detecting the screen movement speed may be enhanced by reducing the amount of data to be compared and searched for.

According to an embodiment, in state 501, the DDI 120 may set a diagonal connecting left upper point coordinates (309, 1) of the display panel 143 with right lower point coordinates (1844, 1536) of the display panel 143. The DDI 120 may compare pixel information items while alternating the upper side and the lower side on the basis of the set diagonal. For example, the DDI 120 may compare information of pixels of a diagonal connecting point coordinates (310, 1), which is higher by one pixel to the upper side than a diagonal connecting left upper point coordinates (309, 1) with right lower point coordinates (1844, 1536), with coordinates (1845, 1536), with information of pixels of a diagonal initially set, and may compare information of pixels of a diagonal connecting coordinates (308, 1) with coordinates (1843, 1536) with the information of the pixels of the diagonal initially set (e.g., initial configuration information of pixels of the diagonal connecting the first coordinates (309, 1) with the second coordinates (1844, 1536)). As described above, the DDI 120 may compare pixel information items of a diagonal at a certain pixel distance to an upper side than the diagonal initially set. When the pixel information items are not identical to each other, the DDI 120 may compare pixel information items of a diagonal at a certain pixel distance to a lower side than the diagonal initially set and may gradually compare pixel information items of a diagonal, which is away from the diagonal initially set, to detect a diagonal having the same pixel information as information of pixels of the diagonal initially set.

According to various embodiments, when a minimum movement range is set, the DDI 120 may compare pixel information items from a location spaced apart at a specified distance. For example, when the screen movement speed is set to a minimum of 5 pixels/frame, the DDI 120 may compare pixel information of a diagonal located over 5 lines (or 5 pixels) from an initial diagonal location to an upper side and diagonals located over 5 lines from the initial diagonal location to a lower side with pixel information of an initial diagonal. According to various embodiments, when a maximum movement range is set, the DDI 120 may compare pixel information items to a specified distance. For example, when the screen movement speed is set to a maximum of 60 pixels/frame, the DDI 120 may compare pixel information items from diagonals located within 60 lines (or 60 pixels) from the initial diagonal location to the upper side to diagonals located within 60 lines from the initial diagonal location to the lower side.

According to an embodiment, when the screen is moved to an upper side by 50 lines (or on the same line by 50 pixels) by a scroll operation, in state 503, as the pixel information items of the diagonal set in state 501 are identical to pixel information items of a diagonal connecting left upper point coordinates (259, 1) with right lower point coordinates (1794, 1536), the DDI 120 may detect movement of the diagonal through comparison of pixel information items and may detect a screen movement speed based on the detected result. For the example above, the screen movement speed may be 50 pixels/frame. For another example, when the screen is moved to a lower side by 60 lines depending on an input associated with screen movement, during the process of comparing the pixel information items of the diagonal set in state 501 with pixel information items of diagonals around the diagonal, in state 505, the DDI 120 may identify that pixel information items of a diagonal connecting left upper point coordinates (369, 1) with right lower point coordinates (1904, 1536) are identical to each other and may calculate the amount of movement (or a scroll speed) of the screen. For example, in state 505, a screen movement speed of 60 pixels/frame may be detected.

Figure 6:
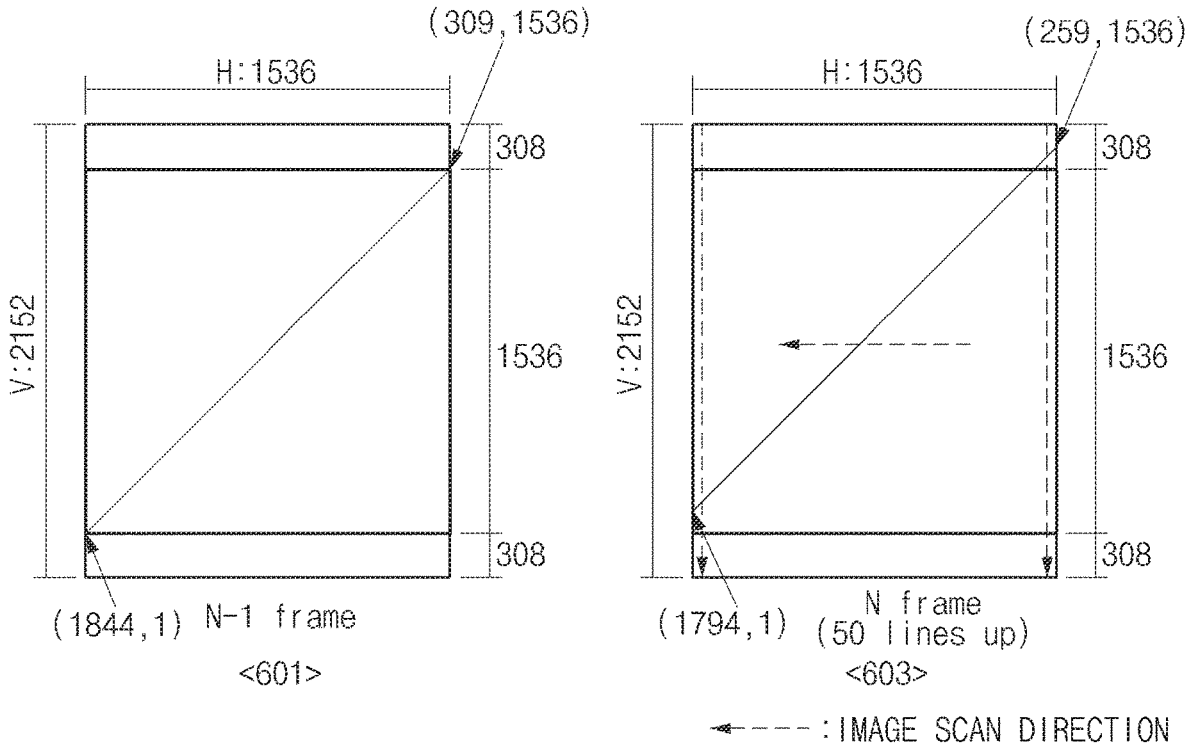
FIG. 6 is an illustration of another example of a method for detecting a screen movement speed according to an embodiment of the disclosure.

FIG. 6 is a drawing illustrating another example of a method for detecting a screen movement speed according to an embodiment of the disclosure.

Referring to FIG. 6, in state 601, a DDI 120 of FIG. 1 may set an initial diagonal connecting first point coordinates (1844, 1) with second point coordinates (309, 1536) and may compare pixel information items of diagonals located within a certain distance to the upper side and diagonals located within a certain distance to the lower side with pixel information items of the initial diagonal to detect a diagonal having the same pixel information. In this operation, the DDI 120 may compare some of pixel information items of the detected specific diagonals with some of pixel information items of the initial diagonal to determine whether the pixel information items are identical to each other. When pixel information items on the same line (e.g., at the same location in a vertical direction) are identical to each other, the DDI 120 may determine whether pixel information items of other portions are identical to each other. When the pixel information items on the same line differ from each other, the DDI 120 may not compare pixel information items of the other portions of the diagonal to skip the diagonal. The DDI 120 may enhance a diagonal detection speed by comparing some of diagonal pixel information items and skipping the other portions. For example, when the screen is moved to the upper side by 50 lines according to an input associated with screen movement, in state 603, the DDI 120 may detect a diagonal while skipping a diagonal having pixel information is not the same as the initial diagonal, until detecting a diagonal connecting point (1794, 1) with point (259, 1536).

According to various embodiments, the DDI 120 may detect a diagonal including the most pixel information items which are the same as pixel information items of the initial diagonal among diagonals within a specified range as a result of comparing the pixel information items of the initial diagonal with pixel information items of other diagonals adjacent to the initial diagonal. According to various embodiments, the DDI 120 may detect a diagonal through a pattern comparison. For example, the DDI 120 may detect a diagonal having the same pattern as a pattern of the pixel information items of the initial diagonal. According to various embodiments, the DDI 120 may detect a diagonal having the most similar pattern to a pattern of the pixel information items of the initial diagonal. In conjunction with performing the above-mentioned operation, when having the same pixel information as the pixel information of the initial diagonal in the process of comparing pixels, the DDI 120 may increase a count as a result of having the same pixel information, as a result, detecting a screen movement speed on the basis of a diagonal where the increased count value is highest. According to various embodiments, the DDI 120 may detect a diagonal while skipping a specified pixel based on input speed (e.g., fling velocity, scroll speed, or touch input change speed) information. Alternatively, the DDI 120 may select only some pixels among diagonal pixel information items and may detect a diagonal and a screen movement speed using only the selected some pixels. According to an embodiment, when the input speed is a specified first speed (or is greater than or equal to the specified first speed), the DDI 120 may increase the number of skipped pixels. According to an embodiment, after skipping specified pixels, the DDI 120 may detect a diagonal on a pixel-by-pixel basis.

Figure 7:
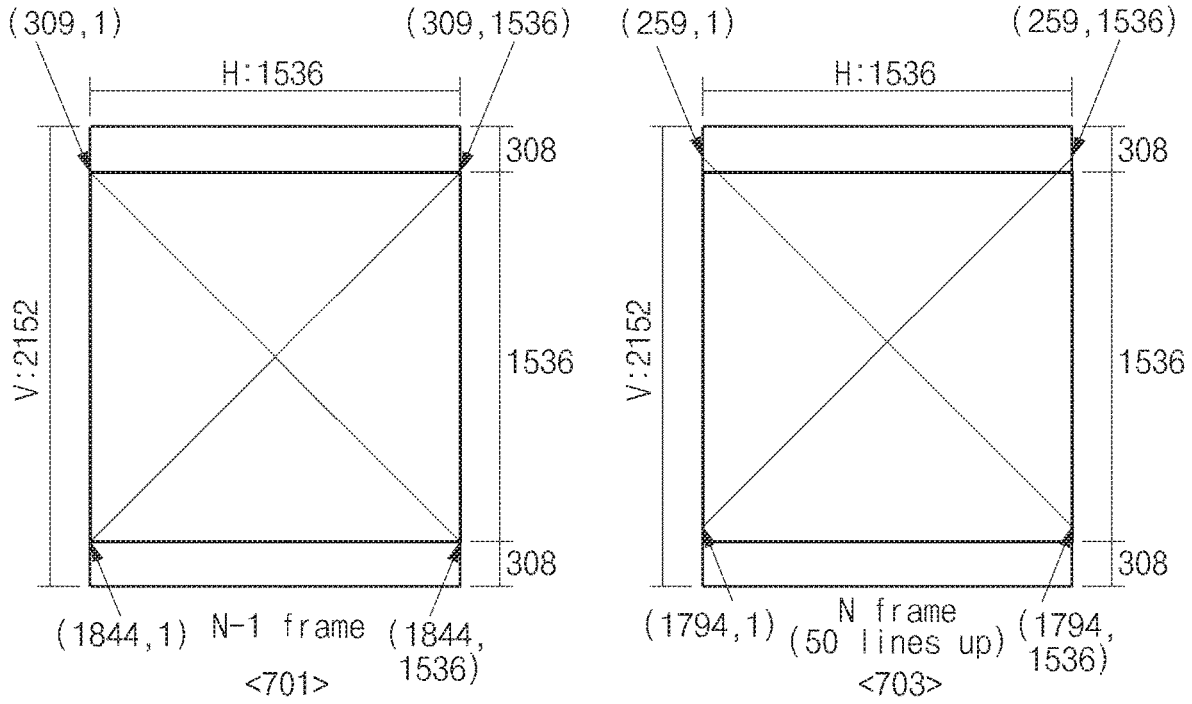
FIG. 7 is an illustration of an example of modifying a method for detecting a screen movement speed according to an embodiment of the disclosure.

FIG. 7 is a drawing illustrating an example of modifying a method for detecting a screen movement speed according to an embodiment of the disclosure.

Referring to FIG. 7, a DDI 120 of FIG. 1 may set a plurality of diagonals in conjunction with detecting a screen movement speed and may detect the screen movement speed on the basis of the plurality of diagonals. For example, in state 701, the DDI 120 may set a first diagonal connecting point (309, 1) with point (1844, 1536) and a second diagonal connecting point (1844, 1) with point (309, 1536) as initial diagonals in a frame N−1. When within a certain distance to the upper and lower sides on the basis of the first diagonal, the DDI 120 may compare pixel information items of other diagonals parallel to the first diagonal with pixel information items of the first diagonal and may detect a diagonal having pixel information items identical to the pixel information items of the first diagonal or a diagonal having the most pixel information items identical to the pixel information items of the first diagonal. In addition, in a subsequent frame N of a state 703, the DDI 120 may detect a diagonal having the same pixel information in the same manner as the first diagonal with respect to the second diagonal. The DDI 120 may detect a screen movement speed using a diagonal detected on the basis of the detected first diagonal and a diagonal detected on the basis of the second diagonal. According to various embodiments, the DDI 120 may set three or more initial diagonals. According to various embodiments, as described above, pixels for detecting the screen movement speed may be pixels corresponding to a diagonal and may be pixels which are present on any line horizontally across a screen. At least a portion of the any line horizontally across the screen may include at least a portion of a straight line and a curve. Alternatively, the any line horizontally across the screen may include a line in a partial region of the screen (e.g., a partial region which is smaller in size than the entire screen).

Figure 8:
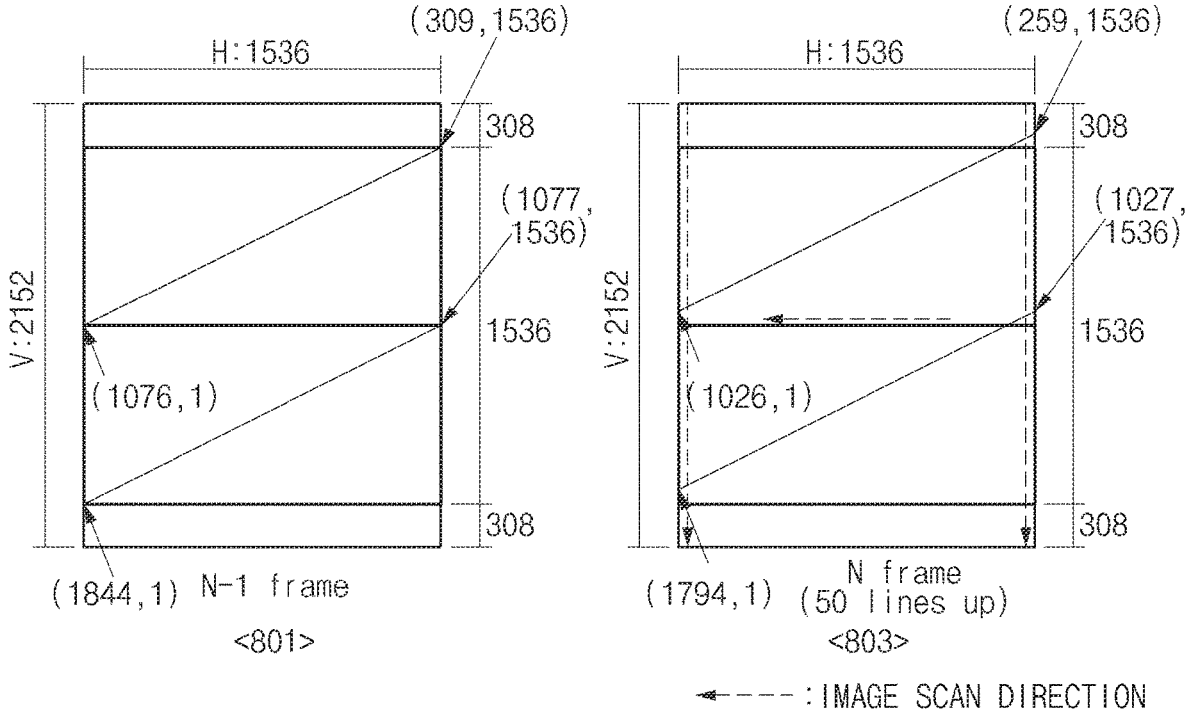
FIG. 8 is an illustration of another example of modifying a method for detecting a screen movement speed according to an embodiment of the disclosure.

FIG. 8 is a drawing illustrating another example of modifying a method for detecting a screen movement speed according to an embodiment of the disclosure.

Referring to FIG. 8, in a frame N−1 of a state 801, a DDI 120 of FIG. 1 may set a plurality of initial diagonals in conjunction with detecting a screen movement speed, which may set initial diagonals covering regions which are not overlapped with each other and may detect the screen movement speed on the basis of the initial diagonals. For example, the DDI 120 may set a first diagonal connecting point (309, 1536) with point (1076, 1) and a second diagonal connecting point (1077, 1536) with point (1844, 1) as initial diagonals. When within a certain distance to the upper and lower sides on the basis of the first diagonal, in a subsequent frame N of a state 803 the DDI 120 may compare pixel information items of other diagonals parallel to the first diagonal with pixel information of the first diagonal and may detect a diagonal having the same pixel information as a plurality of pixels corresponding to the first diagonal or a diagonal having the most same pixels. In addition, the DDI 120 may detect a diagonal having the same pixel information or a diagonal having the most same pixel information items, in the same manner as the first diagonal with respect to the second diagonal.

Figure 9:
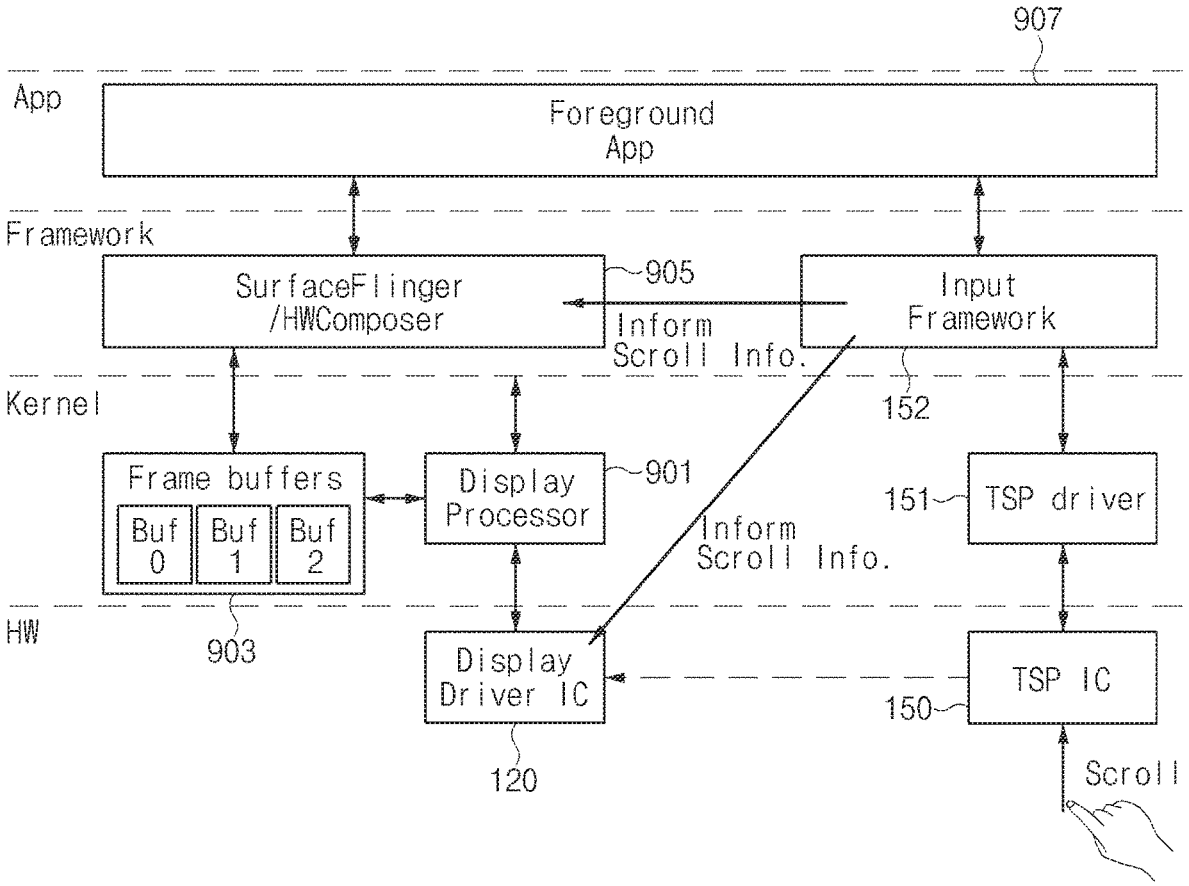
FIG. 9 is an illustration of an example of a hardware operation method associated with detecting a screen movement speed according to an embodiment of the disclosure.

FIG. 9 is a drawing illustrating an example of a hardware operation method associated with detecting a screen movement speed according to an embodiment of the disclosure.

Referring to FIG. 9, an electronic device 100 may operate a touch circuitry 150, a touch driver 151 (or TSP driver), an input framework 152, a DD1 120, a display processor 901 (e.g., a processor 110 of FIG. 1), a frame buffer 903, a composer 905 (or SurfaceFlinger/HWC composer), or an app layer 907 (or Foreground app).

In the electronic device 100 having the above-mentioned configuration, when an input associated with screen movement is received via the touch circuitry 150, the touch driver 151 may process the input associated with the screen movement, which is received by the touch circuitry 150, and may detect a screen movement speed according to the input associated with the screen movement. For example, the touch driver 151 may detect a screen movement speed based on a touch movement distance delivered from the touch circuitry 150. The screen movement speed may be delivered to the DDI 120 via the input framework 152. The DDI 120 may calculate a compensation value to apply compensation based on the delivered screen movement speed.

According to various embodiments, the input framework 152 may deliver a screen movement speed value to the composer 905, and the composer 905 may determine a degree to which display data is compensated, depending on the screen movement speed. When the degree to which the display data is compensated is determined, the composer 905 may transform display data stored in the frame buffer 903 to fit the determined compensation value and may output compensation data on the display 140 via the display processor 901 and the DDI 120.

As described above, the electronic device 100 according to an embodiment may directly calculate a screen movement speed based on touch information obtained by the touch circuitry 150, such that the DDI 120 does not calculate the screen movement speed, and may provide the DDI 120 with the screen movement speed, or may be used to generate compensation data for compensating for screen movement of display data to be output.

As described above, in conjunction with detecting the screen movement speed, according to an embodiment, the processor 110 (or an AP) may detect the screen movement speed and may deliver the screen movement speed to the DDI 120. According to various embodiments, the DDI 120 may detect a screen movement speed based on a screen change in the method described above with reference to FIGS. 4 to 8. According to various embodiments, the touch circuitry 150 of the electronic device 100 may directly deliver a screen movement speed to the DDI 120. In this regard, a signal line may be disposed between the touch circuitry 150 and the DDI 120. According to various embodiments, the input framework 152 may directly deliver information (e.g., screen movement speed information, a fling input speed, or a touch input speed) associated with screen movement to the DDI 120. Alternatively, the input framework 152 may deliver information (e.g., screen movement speed information) associated with screen movement to the composer 905 associated with the processor 110 and the DDI 120 together or at the same time.

Figure 10:
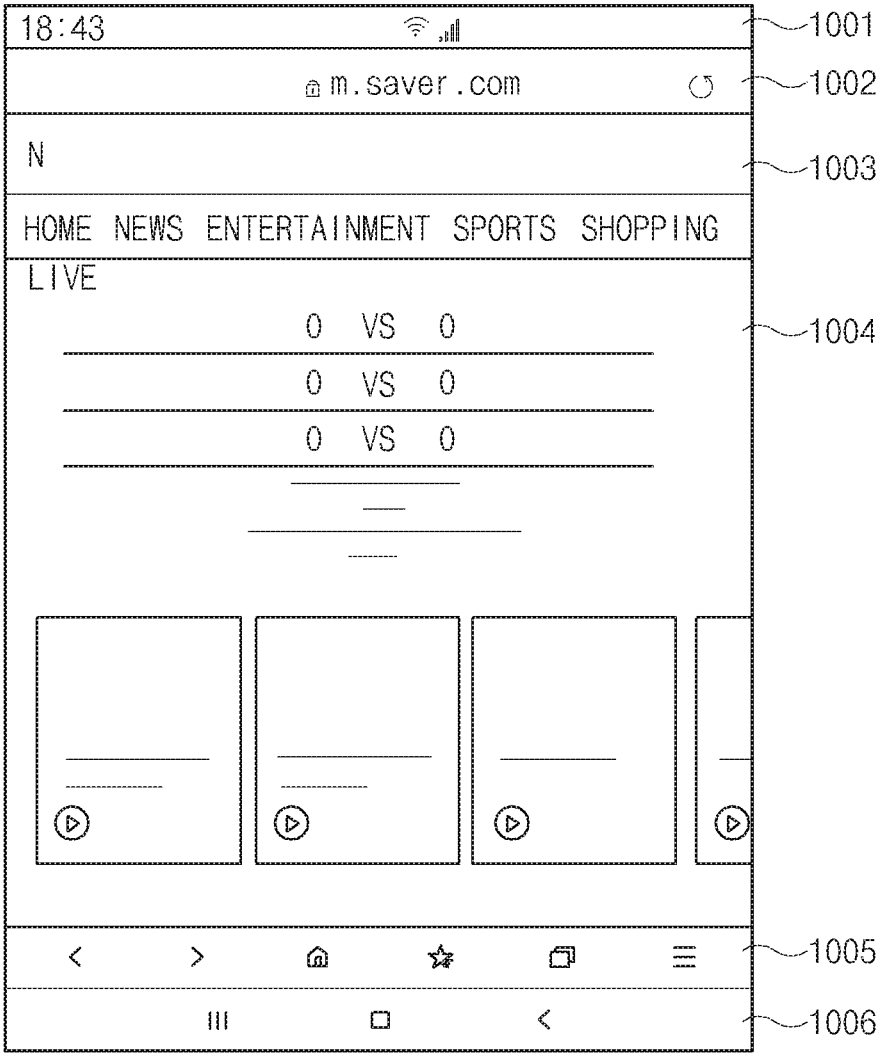
FIG. 10 is an illustration of an example associated with setting a region of interest (ROI) according to an embodiment of the disclosure.

FIG. 10 is a drawing illustrating an example associated with setting an ROI according to an embodiment of the disclosure.

Referring to FIG. 10, in conjunction with setting an ROI, a DDI 120 (or a processor 110) of FIG. 1 may identify a characteristic value for each region of data (or display data, a screen, or an image) to be output on a display 140 of FIG. 1. The characteristic value may be provided by a server or a manufacturer, which provides the screen (or an image or a page). The characteristic value may include for example, a value (e.g., a value defining a characteristic for each region of the screen) where any regions of the screen indicate a region 1001 where a notification bar is displayed, a region 1002 where an address is entered, a menu region 1003 associated with a webpage, a region 1004 where data is updated, a control key region 1005, and a region 1006 where navigation keys capable of searching for another page are located. According to various embodiments, the characteristic value may include a value defining a scrollable region (e.g., a region 1004) and non-scrollable regions (e.g., regions 1001, 1002, 1003, 1005, and 1006). Thus, the DDI 120 (or the processor 110) may set an ROI based on characteristic information defining each region of the screen. For example, the DDI 120 may set the region 1004 where data is updated within a specified time or the scrollable region 1004 to an ROI.

Figure 11:
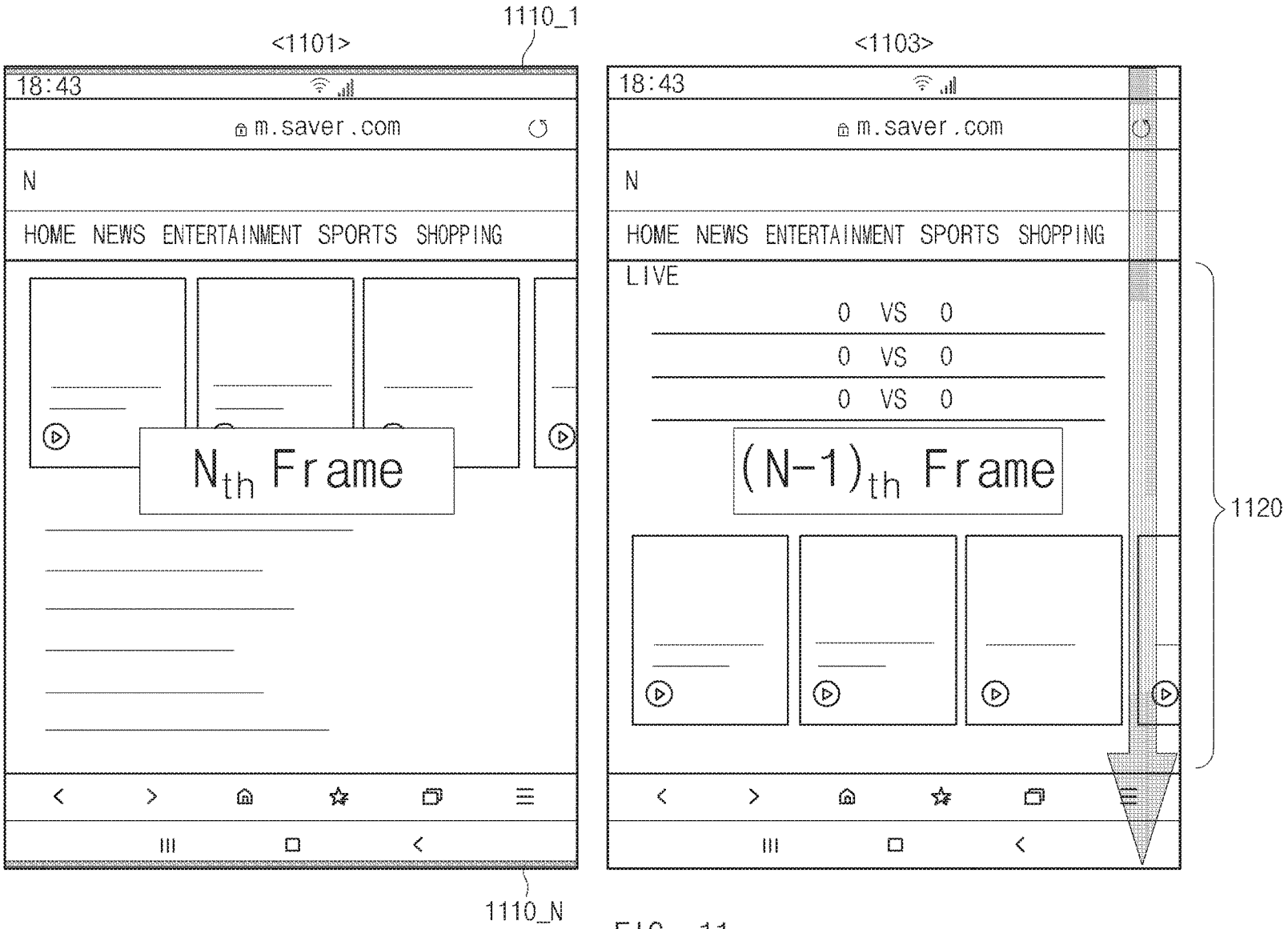
FIG. 11 is an illustration of another example associated with setting an ROI according to an embodiment of the disclosure.

FIG. 11 is a drawing illustrating another example associated with setting an ROI according to an embodiment of the disclosure.

Referring to FIG. 11, in conjunction with setting an ROI, a DDI 120 (or a processor 110) of FIG. 1 may extract a representative value for each line of a screen output on a display 140 of FIG. 1 (e.g., for each horizontal line in a state where content is vertically displayed on the basis of the drawing shown) and may store the extracted representative value for each line (e.g., a value of any location, a representative value (e.g., the largest value, the smallest value, or a value obtained by adding all of pixel values of a corresponding line) among R/G/B values of respective pixels, or an average value for each line) in a memory (e.g., a second memory 129 of FIG. 1). For example, in state 1101, the DDI 120 may extract representative values from a first line 1110_1 of a screen which is outputting on the display 140 to the last line 1110N and may store the representative value for each extracted line in the memory. When a location of the screen is changed in state 1103 depending on an input associated with screen movement, the DDI 120 may calculate a representative value for each line of the changed screen and may compare the calculated representative value for each line with a representative value for each line of a previous frame stored in the memory.

According to various embodiments, the DDI 120 may extract a region 1120 where there is a change in representative value from the first line to the last line and may set the region 1120 to an ROI. The representative value for each line may include the largest pixel value or the smallest pixel value on a corresponding line (a value of a pixel where a value calculated by digitizing the pixel is largest or smallest). According to various embodiments, the DDI 120 may store an average value of pixels for each line in the memory and may compare the average value stored in the memory with an average value of pixels for each line of a next frame to identify a change. According to various embodiments, the DDI 120 may store a variance value of pixels for each line in the memory and may compare the variance value stored in the memory with a variance value of pixels for each line of a next frame to identify a change. According to various embodiments, the DDI 120 may store a checksum value (e.g., a CRC code value) assigned for each line in the memory and may compare the checksum value stored in the memory with a checksum value for each line of a next frame to identify a change. The DDI 120 may set a region, where there is a change or where a degree of change is greater than or equal to a specified value, to an ROI.

According to various embodiments, when an image frame corresponding to a multi-window is displayed on a display panel 143 of FIG. 1, the DDI 120 may determine an ROI depending on whether a touch input is received on any of a plurality of application execution regions included in the multi-window or whether a region currently focused is any region. For example, the DDI 120 may determine an ROI based on a frame region to which screen movement is currently applicable among the plurality of application execution regions included in the multi-window. For example, the DDI 120 may determine at least a portion of a frame region of a region on which a touch input occurs or a frame region currently focused as an ROI.

According to various embodiments, in a state where the multi-window is displayed, the DDI 120 may determine a central region (or a region where a pixel of the screen is changed over a specified value), except for upper and lower (or left and right) some regions from a region of a certain size or a frame region currently focused, about a point on which a touch input occurs in a frame region (or an application execution region) on which the touch input occurs, as an ROI.

In the description above, in a state where a screen of a display 140 of FIG. 1 is equally divided or is unequally divided, the multi-window may include a state where each application execution screen is displayed for each divided region. Alternatively, the multi-window may include a state where an execution screen according to execution of a first application is provided as a background of the display 140 depending on a picture in picture (PIP) function and where a screen according to execution of a second application different from the first application is displayed as a screen smaller than the background screen.

Figure 12:
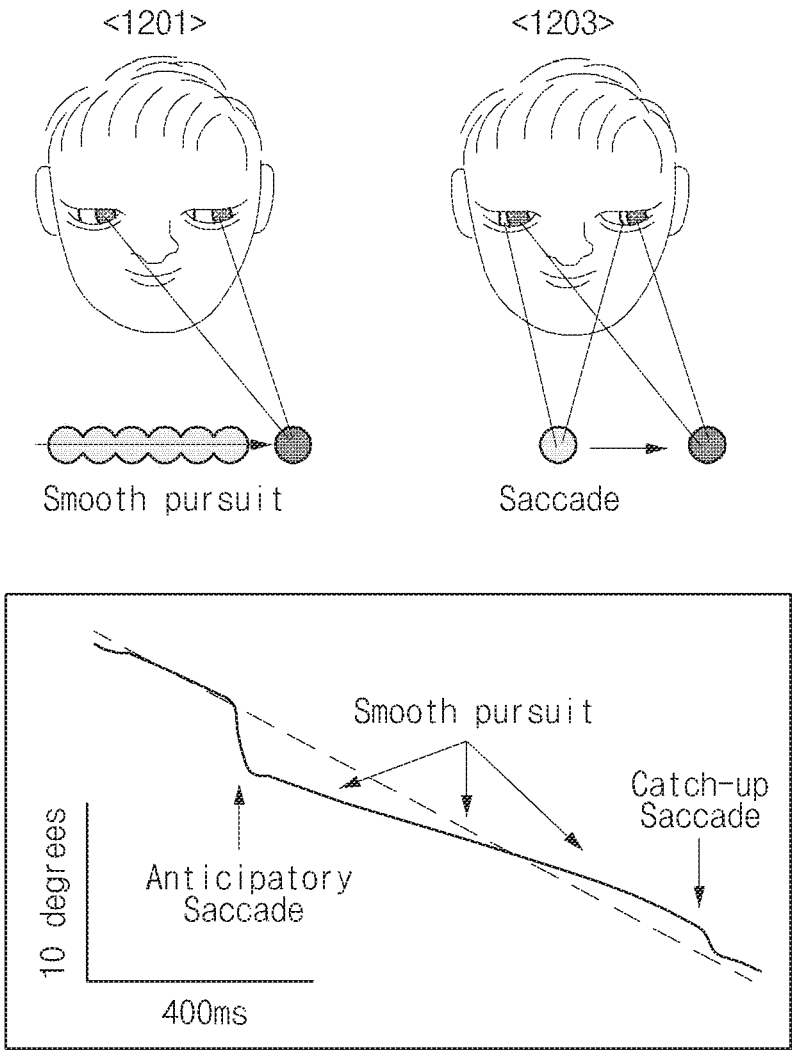
FIG. 12 is an illustration of a change in visibility associated with eye tracking according to an embodiment of the disclosure.

FIG. 12 is a drawing illustrating a change in visibility associated with eye tracking according to an embodiment of the disclosure.

Referring to FIG. 12, in a state where a screen is output on a display 140 of FIG. 1, when the screen is moved according to an input associated with screen movement, in state 1201, a line of sight of a user may be moved along a certain point of the moved screen. In this case, when a gate signal is provided from the left to the right, an update time of a gate signal line adjacent to a region to which the gate signal is relatively first input may be faster than an update time of another gate line. At this time, when a line of sight of the user performs smooth pursuit along a certain point of the screen, a jelly scroll phenomenon where the screen is moved in a tilted state may occur on eyes of the user.

Furthermore, when a movement speed of the screen is greater than or equal to a specified speed, in state 1203, a saccade phenomenon may occur. When the movement speed of the screen is greater than or equal to the specified speed, the saccade may allow the eyes of the user to recognize that the movement of the screen does not perform smooth pursuit and that a certain point of the screen moves to another point in a moment. In this case, a moment image of the screen is visible to the eyes of the user (e.g., a discontinuous moment image is visible (to the eyes) or there may be an increase in probability that an inverse image will be visible due to compensation upon the compensation of screen movement).

As described above, while the eyes of the user track movement of the screen, smooth pursuit and saccade may alternately occur depending on movement speed of the screen. Thus, as shown in FIG. 13, the electronic device 100 may compensate different screen movement for each interval depending on a screen movement speed.

Figure 13:
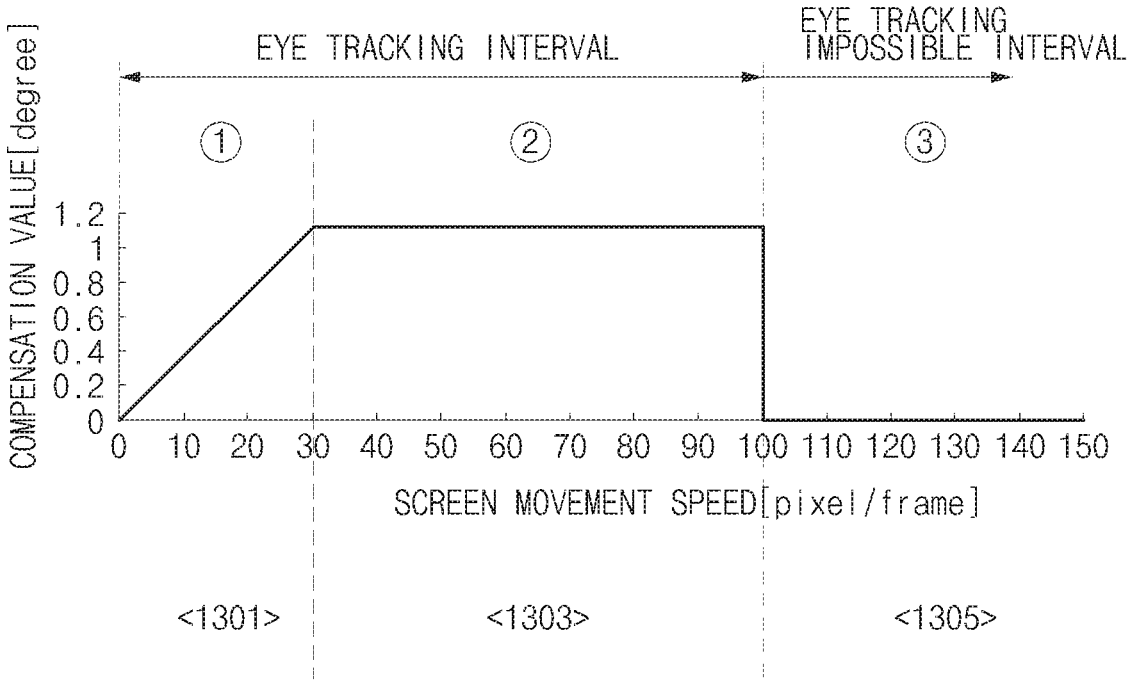
FIG. 13 is an illustration of an example of a change in the amount of compensation according to eye tracking according to an embodiment of the disclosure.

FIG. 13 is a drawing illustrating an example of a change in the amount of compensation according to eye tracking according to an embodiment of the disclosure.

Referring to FIG. 13, in the graph shown, a DDI 120 (or a processor 110) of FIG. 1 may apply a different compensation value for each interval of a screen movement speed. In a first interval (a smooth pursuit interval) where a screen movement speed is greater than or equal to 0 and is less than 30 pixels/frame, the DDI 120 may increase a compensation value in a linear manner depending on an increase in screen movement speed. According to an embodiment, the DDI 120 (or the processor 110) may increase a compensation value in a non-linear manner while changing a slope. According to an embodiment, in an interval where the screen movement speed is less than 10 pixels/frame, the DDI 120 (or the processor 110) may fail to apply a compensation value depending on a change in screen movement speed. In other words, a compensation value (or the amount of screen tilt compensation) may be 0.

As the compensation value increases, the DDI 120 may increase the number of equal parts which divides the screen. In this regard, the DDI 120 may adaptively compensate for a tilt of data (e.g., at least one of an image or a text) displayed on the screen by increasing the compensation value as the screen movement speed increases.

According to various embodiments, in a second interval (the smooth pursuit interval+a saccade interval) where the screen movement speed is greater than or equal to 30 pixels/frame and is less than 100 pixels/frame, the DDI 120 may apply a compensation value smaller than an increase in screen movement speed. In this regard, because there is a risk that an inverse image (a compensation image) will be visible depending on occurrence of saccade at a screen movement speed of a certain level or more, the DDI 120 may apply a compensation value smaller than the screen movement speed or may apply only a specified compensation value. According to various embodiments, in the second interval, the DDI 120 may apply a certain compensation value irrespective of an increase in screen movement speed.

According to various embodiments, in a third interval (an eye tracking impossible interval) where the screen movement speed is greater than or equal to 100 pixels/frame, the DDI 120 may fail to apply a compensation value irrespective of occurrence of a scroll operation. Alternatively, the DDI 120 may set the compensation value to 0 to apply the compensation value. According to various embodiments, the DDI 120 may maintain a maximum compensation value of a previous interval or may gradually reduce a compensation value on the basis of the maximum compensation value of the previous interval.

When the screen movement speed is greater than or equal to a specified value, because it is unable for the eyes of the user to recognize a jelly scroll phenomenon depending on screen movement or because it is difficult for the eyes of the user to feel a sense of incompatibility according to it although the eyes of the user recognizes the jelly scroll phenomenon, the DDI 120 may fail to apply a separate compensation value. According to various embodiments, to naturally process screen movement, a start compensation value of each interval may be the same as a last compensation value of a previous interval.

In the graph of FIG. 13 described above, a reference screen movement speed (e.g., 30 pixels/frame or 100 pixels/frame) differently applying a compensation scheme may be differently defined according to the entire size of a display 140 of FIG. 1 or the entire size of a scrolled region. Alternatively, the reference screen movement speed may be differently defined according to the number of gate lines of the display 140, a gate scan speed, or the like. According to various embodiments, the interval may be divided on the basis of the two reference screen movement speeds (e.g., 30 pixels/frame and 100 pixels/frame) in the graph of FIG. 13, but the interval may be divided into more intervals on the basis of a plurality of three or more reference screen movement speeds (e.g., 10 pixels/frame, 20 pixels/frame, 30 pixels/frame, 50 pixels/frame, 70 pixels/frame, 90 pixels/frame, and the like) and a compensation value may be differently defined for each interval. Alternatively, the interval may be divided into a linear increase interval 1301, a maintenance interval 1303, and an impossible interval 1305 on the basis of each reference value (30 pixels/frame or 100 pixels/frame) in the graph of FIG. 13, but a compensation value may be applied according to a graph of a curved form without interval division like a logarithmic graph. For example, in the interval 1301 or 1303, the compensation value for each scroll speed may increase or decrease according to an exponential function or a logarithmic function.

Figure 14:
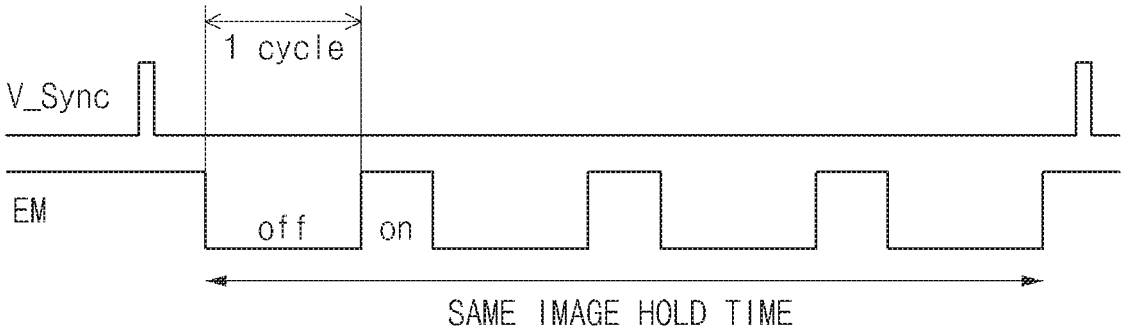
FIG. 14 is an illustration of weight adjustment associated with representing the same screen according to an embodiment of the disclosure.
Figure 14:
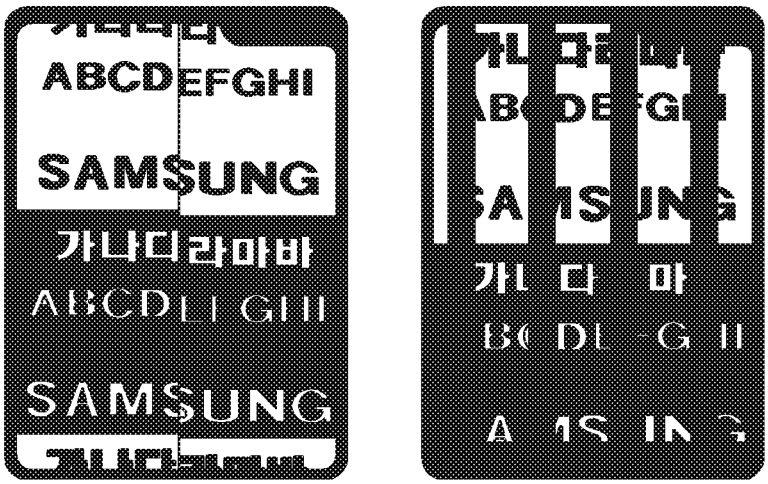

FIG. 14 is a drawing illustrating weight adjustment associated with representing the same screen according to an embodiment of the disclosure.

Referring to FIG. 14, an electronic device 100 of FIG. 1 may differently operate the same image hold time during a specified period (e.g., 1 Vsync or a driving cycle). An interval where an image is not displayed may be included in the same image hold time. A DDI 120 (or a processor 110) of FIG. 1 may change a weight of a compensation value depending on a duty ratio of an interval where an image is displayed on a display 140 of FIG. 1 and an interval where an image is not displayed on the display 140. For example, the DDI 120 (or the processor 110) may change the weight of the compensation value depending on Equation 1 or 2.

$$\text{Weight (\%)}=(\text{same image hold time})/(\text{display driving cycle})\times 100\% \quad \text{Equation 1}$$

$$\text{Weight (\%)}=100-AOR/\text{No_of_duty_cycles_per_}V\text{period} \quad \text{Equation 2}$$

The No_of_duty_cycles_per_Vperiod may refer to a cycle of a signal provided to represent an image per 1 driving cycle (e.g., 1 frame or 1 Vsync). The weight calculated using Equation 1 above may be multiplied by a compensation value calculated based on a screen movement speed, and thus, a compensation value to the weight is applied may be applied to a real screen. For example, when the number of duty cycles is 1 (e.g., four duty cycles for 1 Vsync) and when a display off ratio (AOR) is 30% (when a ratio where the display is off is 30%), the weight may be 92.5%.

Figure 15:
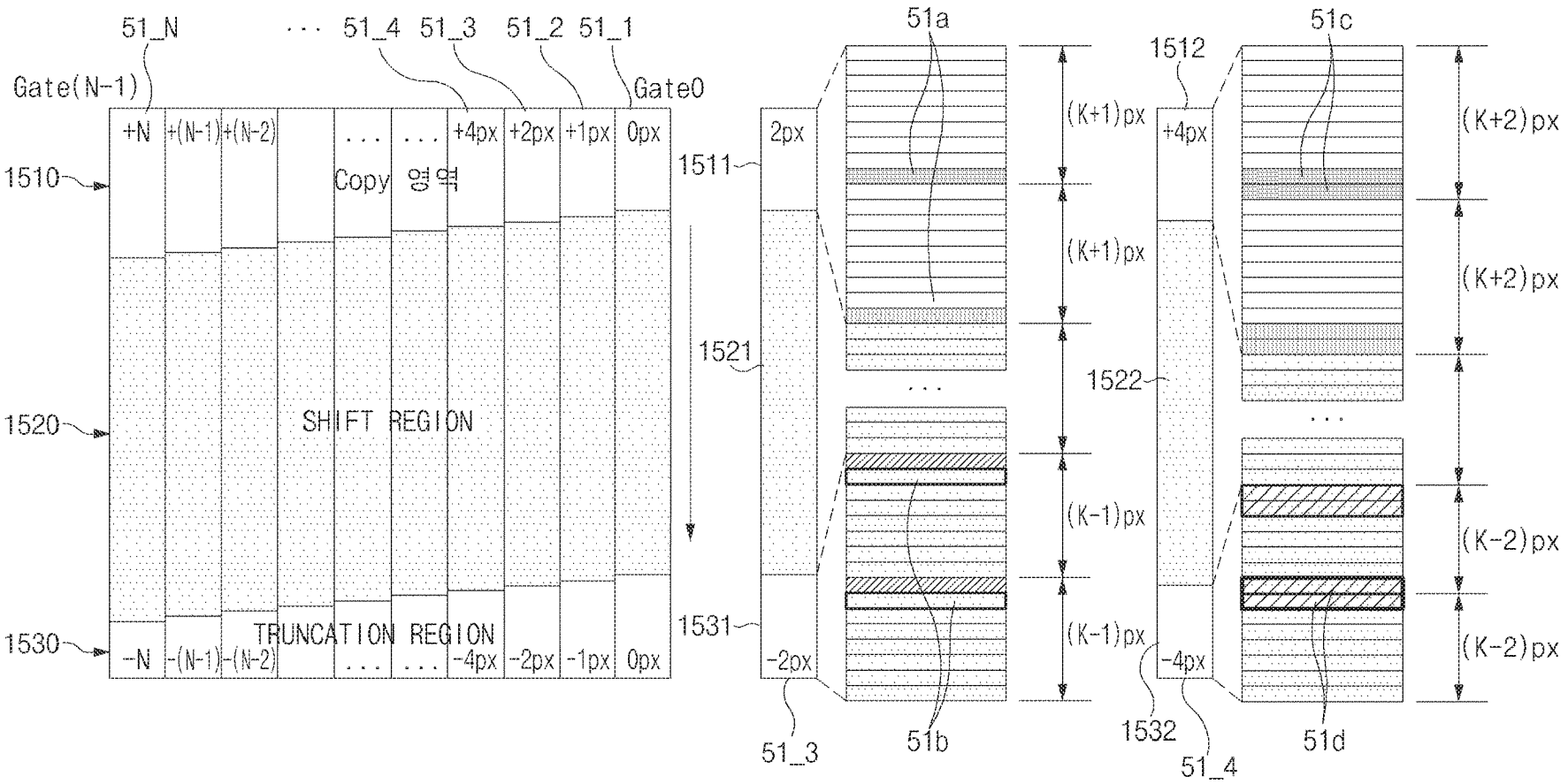
FIG. 15 is an illustration of an example of applying a compensation value according to an embodiment of the disclosure.

FIG. 15 is a drawing illustrating an example of applying a compensation value according to an embodiment of the disclosure.

Referring to FIG. 15, a DDI 120 (or a processor 110, hereinafter a description will be given of the DDI 120) may generate compensation data based on one frame. For example, when a screen movement speed is detected, the DDI 120 may determine a compensation value (or the amount of compensation) according to the detected screen movement speed. When the compensation value is determined, the DDI 120 may equally divide a screen depending on the determined compensation value. For example, when the screen movement speed is a first speed value (or a first speed interval), as shown, the DDI 120 may equally divide at least a portion of the screen into a plurality of sub-regions in a direction (or a gate scan direction) perpendicular to a screen movement direction. According to an embodiment, the DDI 120 may equally divide a screen region into N sub-regions 51_1 to 51_N. The number of N may be varied according to the screen movement speed. For example, the DDI 120 may increase the number of N when the screen movement speed increases and may decrease the number of N when the screen movement speed decreases. As described above with reference to FIG. 14, the DDI 120 may additionally adjust the number of N (e.g., a compensation value) by applying a weight depending on a duty ratio (an on/off ratio of a duty or an on/off arrangement ratio in one period) at which data is output on a display 140 of FIG. 1 and the number of duty cycles. According to an embodiment, when one equal division is one pixel, it may be one pixel unit.

According to an embodiment, the DDI 120 may divide each sub-region 51_1, 51_2, 51_3, . . . , or 51_N into three regions (e.g., a data copy region 1510, a data shift region 1520, and a data truncation region 1530) and may add or delete data on at least some of the divided regions to generate compensation data. For example, the DDI 120 may add or remove data with respect to at least some of all the sub-regions 51_1 to 51_N.

According to an embodiment, in at least a portion of the equally divided sub-regions, for example, in the third sub-region 51_3, the DD1 120 may insert first additional data 51*a* into a first data copy region 1511. In this operation, the DDI 120 may set a certain number of pixel lines among pixel lines (including a plurality of pixels) in the vertical direction as one group and may copy or use at least some of data of pixel lines which belong to the one group (e.g., apply at least one of various interpolation methods) to generate the first additional data 51*a*. For example, in the drawing shown, the DDI 120 may set 8 pixel lines as one group and may generate the first additional data 51*a* from data of the 8 pixel lines to add the first additional data 51*a* to the first data copy region 1511. The DDI 120 may vary the number of groups included in the first data copy region 1511 depending on a screen movement speed. For example, the quicker the screen movement speed, the more the number of the groups may be. According to various embodiments, when the number of groups is fixed, the quicker the screen movement speed, the more increased the number of pixel lines which belong to the group may be. According to various embodiments, the quicker the screen movement speed, the more increased the number of groups may be. The number of pixel lines assigned to the group may be reduced. The slower the screen movement speed, the more decreased the number of pixel lines which belong to the group may be. According to various embodiments, the slower the screen movement speed, the more decreased the number of groups may be. The number of pixel lines assigned to the group may be increased.

In the drawing shown, the DDI 120 may set 2 groups including 8 pixel lines as the first data copy region 1511, with respect to at least some sub-regions 51_2 to 51_N, and may generate the first additional data 51*a* to add the first additional data 51*a* to the corresponding group. According to various embodiments, the first additional data 51*a* may be generated through interpolation of data values of the 8 pixel lines (e.g., one additional data may be generated by collecting ⅛ of data of respective pixel lines). According to various embodiments, the DDI 120 may select specific data among data in the first data copy region 1511 and may copy the selected data to generate additional data.

According to an embodiment, in the at least some sub-regions 51_2 to 51_N among the equally divided sub-regions, the DD1 120 may perform location movement according to a screen movement speed with respect to the first data shift region 1521. A movement distance of the first data shift region 1521 may be determined according to the number of additional data of the first data copy region 1511 and the number of removal data of the first data truncation region 1531.

According to an embodiment, in the at least some sub-regions 51_2 to 51_N among the equally divided sub-regions, the DD1 120 may remove first candidate data 51*b* from the first data truncation region 1531. In this regard, the DDI 120 may select a plurality of groups, each of which includes a plurality of pixel lines, in conjunction with a configuration of the first data truncation region 1531. The DDI 120 may select first candidate data 51*b* to be removed from each group. The DDI 120 may remove the selected first candidate data 51*b* from the corresponding group. The number of groups from which the first candidate data 51*b* is removed may be varied according to a screen movement speed. For example, as the screen movement speed increases, the DDI 120 may increase the number of groups from which the first candidate data 51*b* is removed. According to various embodiments, the DDI 120 may select some data from each of the plurality of pixel lines and may constitute the first candidate data 51*b* to be removed. For example, when 8 pixel lines constitute one group, the DDI 120 may select data at intervals of ⅛ data from each pixel line and may constitute the first candidate data 51*b*.

According to various embodiments, the DDI 120 may increase data to be added to sub-regions which are away from a gate driver 141 of FIG. 1 and may increase candidate data to be removed from the sub-regions. For example, the DDI 120 may constitute second additional data 51*c* to be more than the first additional data 51*a*, in a second data copy region 1512 in the fourth sub-region 51_4. For example, when the first additional data 51*a* corresponds to two pixel line, the DDI 120 may constitute the second additional data 51*c* to correspond to four pixel lines. Similarly, the DDI 120 may constitute second candidate data 51*d* to be more than the first candidate data 51*b*. Thus, a second data shift region 1522 may move to a location different from the first data shift region 1521. A movement distance of the second data shift region 1522 may be determined according to the number of additional data of the second data copy region 1512 and the number of removal data of the second data truncation region 1532

According to an embodiment, when the screen movement direction is a first direction (e.g. a direction which is perpendicular to a gate scan direction and moves from the upper side to the lower side), the DDI 120 may gradually increase data to be added to the data copy region 1510 as going from a sub-region adjacent to a region to which a gate signal is relatively first input to a sub-region away from the region. Alternatively, the DDI 120 may gradually increase candidate data to be removed from the data truncation region 1530 as going from a sub-region adjacent to a region to which a gate signal is relatively first input to a sub-region away from the region.

According to various embodiments, when the screen movement direction is a second direction (e.g. a direction opposite to the first direction), the DDI 120 may gradually decrease data to be added to the data copy region 1510 as going from a sub-region adjacent to a region to which a gate signal is relatively first input to a sub-region away from the region. Alternatively, the DDI 120 may gradually decrease candidate data to be removed from the data truncation region 1530 as going from a sub-region adjacent to a region to which a gate signal is relatively first input to a sub-region away from the region.

As described above, as the location of the data shift region 1520 is gradually inclined in a gate scan direction through the data copy region 1510 and the data truncation region 1530, as a result, the screen is visible as being moved at the same time on the basis of the horizontal line along with imbalance of a data update speed which is generated according to scroll movement.

According to various embodiments, when a screen movement speed is detected, the DDI 120 may determine a compensation value (or the amount of compensation) according to the detected screen movement speed. When the compensation value is determined, the DDI 120 may expand an image of a screen region, a screen tilt of which should be compensated according to the determined compensation value, in a scroll direction (e.g., an upward and downward direction or a left and right direction). The DDI 120 may transform the expanded image into a tilted image (e.g., compensation data) based on the compensation value and may display only a portion of a central portion of the titled image on the screen.

As described above, because it is able to generate the compensation data using one frame (image) data in the DDI 120 when generating the compensation data, two frame data may fail to be needed in generating the compensation data. Due to this, a memory space in the DDI 120 may be saved.

Figure 16:
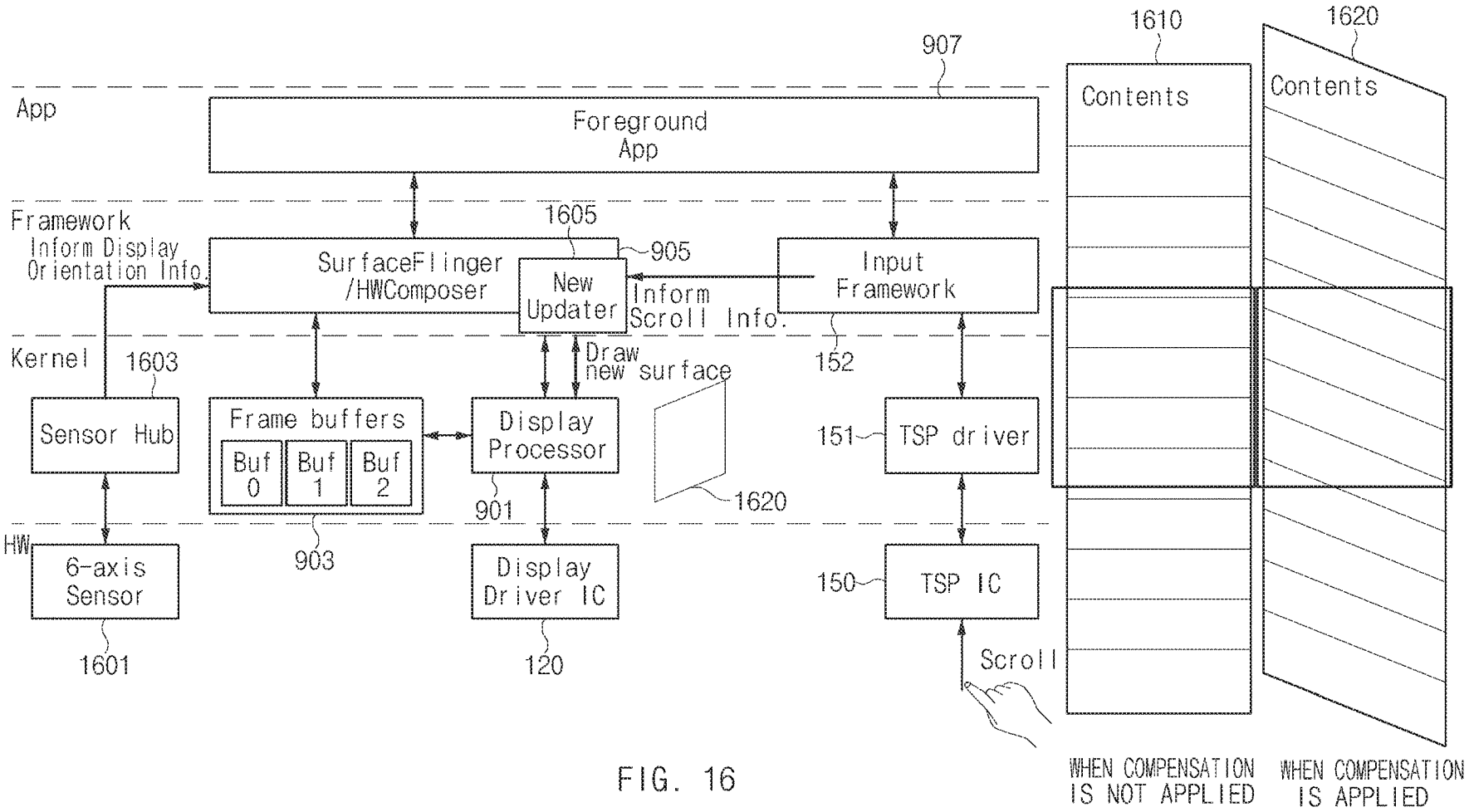
FIG. 16 is an illustration of another example of applying a compensation value according to an embodiment of the disclosure.

FIG. 16 is a drawing illustrating another example of applying a compensation value according to an embodiment of the disclosure.

Referring to FIG. 16, an electronic device 100 may operate a touch circuitry 150, a touch driver 151, an input framework 152, a DD1 120, a display processor 901 (e.g., an AP), a frame buffer 903, a composer 905, an app layer 907, a sensor (e.g., a 6-axis sensor) 1601, or a sensor hub 1603.

In the electronic device 100 having the above-mentioned configuration, when an input associated with screen movement is received via the touch circuitry 150, the touch driver 151 may process the input associated with the screen movement, which is received by the touch circuitry 150, and may deliver screen movement information to the input framework 152. The input framework 152 may deliver the screen movement information to an update module 1605 of the composer 905. The update module 1605 may obtain a screen movement speed from the screen movement information and may calculate a compensation value for compensation depending on the screen movement speed, thus delivering the compensation value to the display processor 901. The display processor 901 may generate compensation data 1620 to be output on a display 140 of FIG. 1 depending on the compensation value and may deliver the generated compensation data 1620 to the DDI 120 to be output on the display 140. According to various embodiments, the compensation data 1620 may be generated by at least one of the DDI 120 and the application processor (AP) (e.g., an update module).

In the above-mentioned operation, the composer 905 may receive sensor information associated with arrangement of the electronic device 100 from the sensor hub 1603 and may identify a gate scan direction depending on the sensor information. According to various embodiments, the composer 905 may identify a direction where content is output according to a user input and may identify a gate scan direction based on the sensor information and the content output setting direction. When the gate scan direction is determined, the composer 905 may determine whether the gate scan direction differs from a screen movement direction. When the gate scan direction differs from the screen movement direction, the composer 905 may generate compensation data 1620 to the display processor 901 based on the update module 1605.

The compensation data 1620 may be a screen where a screen output on the display 140 is tilted in response to a screen movement speed. The display processor 901 may differently determine a degree to which the screen is tilted, depending on the screen movement speed on the basis of the non-compensation data 1610 to which scroll compensation is not applied. The display processor 901 may obtain data of a certain region to be output on the display panel 143 from the compensation data 1620 inclined at a certain slope and may output the obtained data on the display 140 via the DDI 120.

Figure 17:
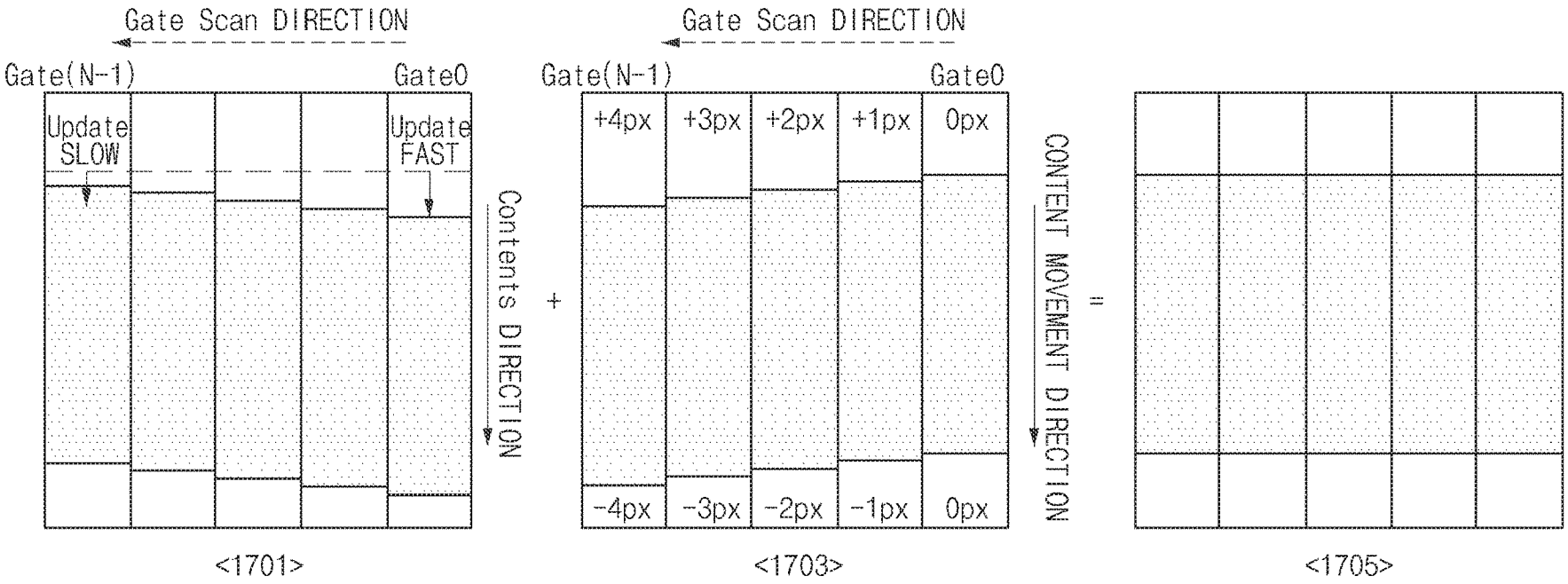
FIG. 17 is an illustration of an example of the concept of compensating for a screen movement according to an embodiment of the disclosure.

FIG. 17 is a drawing illustrating an example of the concept of compensating for screen movement according to an embodiment of the disclosure.

Referring to FIG. 1, after a display 140 of FIG. 1 is turned on, when an input associated with screen movement occurs, in state 1701, as a sub-region of a display panel 142, which is adjacent to a region to which a gate signal is relatively first input, is faster in data update speed than a sub-region of the display panel 143, which is spaced apart from a gate driver 141, a jelly scroll phenomenon may occur.

Referring to FIG. 17, thus, in state 1703, a DDI 120 or a processor 110 of an electronic device 100 of FIG. 1 may generate compensation data where data addition and data removal are differently set according to a separation distance from the gate driver 141. By applying the compensation data generated in state 1703 to the situation where the jelly scroll phenomenon occurs depending on the input associated with the screen movement, in state 1705, the electronic device 100 may output a normal screen from which the jelly scroll phenomenon is removed on the display 140.

According to various embodiments, the above-mentioned description is given of, but not limited thereto, the embodiment of equally dividing the screen (or the display data or the image output on the screen). For example, the electronic device 100 may perform non-uniform division in dividing a screen depending on a screen movement speed. For example, in the electronic device 100, a sub-region adjacent to a region to which a gate signal is relatively first provided may be formed to be larger in size than a sub-region adjacent to a region to which the gate signal is provided relatively later on the display 140. The number of non-uniform division regions may be varied according to a screen movement speed. According to various embodiments, the sub-region adjacent to the region to which the gate signal is relatively first provided may be smaller as a screen movement speed increases.

As described above, an electronic device (e.g., an electronic device 100 of FIG. 1) according to an embodiment may include a display (e.g., a display 140 of FIG. 1) configured to output a screen and at least one processor (e.g., a processor 110 or a DDI 120 of FIG. 1) operatively connected to the display. The at least one processor (e.g., at least one of an application processor or a display driver IC) may be configured to receive a user input associated with movement of the screen output on the display, detect a screen movement speed according to the user input associated with the screen movement, determine an amount of screen tilt compensation according to the screen movement based on the screen movement speed, when the screen movement speed is included in a first interval, and keep the amount of screen tilt compensation based on the screen movement speed constant, when the screen movement speed is included in a second interval faster than the first interval.

According to various embodiments, the at least one processor may set the amount of screen tilt compensation to 0, when the amount of screen tilt compensation based on the screen movement speed is kept constant.

According to various embodiments, the at least one processor may set the amount of screen tilt compensation to a specific value rather than 0, when the amount of screen tilt compensation based on the screen movement speed is kept constant.

According to various embodiments, the at least one processor may set the amount of screen tilt compensation according to the screen movement based on the screen movement speed to 0, when the screen movement speed is included in a third interval faster than the second interval.

According to various embodiments, the at least one processor may set the amount of screen tilt compensation according to the screen movement based on the screen movement speed to 0, when the screen movement speed is included in an interval slower than the first interval.

According to various embodiments, the at least one processor may set a change in the amount of screen tilt compensation according to the screen movement speed in a linear manner, when determining the amount of screen tilt compensation according to the screen movement based on the screen movement speed, According to various embodiments, the at least one processor may set a change in an amount of compensation according to the screen movement speed in a non-linear manner, when determining the amount of screen tilt compensation according to the screen movement based on the screen movement speed.

An electronic device (e.g., an electronic device 100 of FIG. 1) according to various embodiments may include a display (e.g., a display 140 of FIG. 1) configured to output a screen and at least one processor (e.g., a processor 110 or a DDI 120 of FIG. 1) operatively connected to the display. The at least one processor (e.g., at least one of an application processor or a display driver IC) may be configured to receive a user input associated with movement of a screen output on the display, detect a screen movement speed according to the user input associated with the screen movement, and differently determine an amount of screen tilt compensation of at least a partial screen region according to the screen movement, depending on the screen movement speed.

According to various embodiments, the at least one processor may be configured to determine a number to equally divide a current screen frame depending on the screen movement speed (or the amount of compensation), divide each of the equally divided screen regions (e.g., 51_1 to 51_N of FIG. 15) into a central region (e.g., a data shift region 1520 of FIG. 15), a data copy region (e.g., a data copy region 1510 of FIG. 15), and a data truncation region (e.g., a data truncation region 1530 of FIG. 15) in the current screen frame, and perform a compensation operation of adding a certain amount of data to the data copy region and removing and displaying the same amount of data as the added data from the data truncation region while moving the central region in a direction opposite to the a movement of the screen.

According to various embodiments, the at least one processor may differently assign sizes of the data copy region and the data truncation region depending on a magnitude of the screen movement speed (or the amount of compensation).

According to various embodiments, the data copy region may include a region (e.g., at least some screen regions at an edge in an upper direction or a lower direction of the display) disposed in a first direction of the display, when the screen movement direction is from the first direction (e.g., an upper direction or a lower direction) to a second direction (e.g., the lower direction or the upper direction), and the data truncation region may include a region (e.g., at least some screen regions at an edge in the lower direction or the upper direction of the display) disposed in the second direction of the display, when the screen movement direction is from the first direction to the second direction.

According to various embodiments, the data copy region may include a region disposed in a second direction of the display, when the screen movement direction is from the second direction to a first direction, and the data truncation region may include a region disposed in the first direction of the display, when the screen movement direction is from the second direction to the first direction.

According to various embodiments, the at least one processor may be configured to divide a plurality of pixel lines included in the data copy region into a plurality of groups and generate data to be added through interpolation of pixel lines in each of the plurality of divided groups.

According to various embodiments, the number of the data to be added may be differently determined according to a location of the equally divided screen region.

According to various embodiments, the at least one processor may be configured to divide a plurality of pixel lines included in the data truncation region into a plurality of groups and configure (or determine) data (candidate data) to be removed, using some data on respective pixel lines included in the plurality of groups.

According to various embodiments, the number of the data to be removed may be differently determined according to a location of the equally divided screen region.

According to various embodiments, the region disposed in the first direction and the region disposed in the second direction may be differently assigned in size according to a location of the equally divided screen.

According to various embodiments, the at least one processor may be configured to assign a data copy region of screen regions being updated relatively first by a gate driver (e.g., a gate driver 141 of FIG. 1) to be larger or smaller than a data copy region of screen regions being updated relatively later than by the gate driver.

According to various embodiments, the at least one processor may be configured to assign a data truncation region of screen regions being updated relatively first by a gate driver to be smaller or greater than a data truncation region of screen regions being updated relatively later by the gate driver.

According to various embodiments, the at least one processor may be configured to assign a large number to equally divide the current screen frame as the screen movement speed (or the amount of compensation) increases.

According to various embodiments, the at least one processor may be configured to extract a region of interest (ROI) (e.g., a scrollable region 1004 of FIG. 10 or a region 1120 where at least some pixel values are changed in FIG. 11) from a screen displayed on the display and add and remove the data within the ROI.

According to various embodiments, the at least one processor may be configured to detect the screen movement speed based on a change in pixel information on a segment connecting a first point of the display with a second point of the display.

According to various embodiments, the segment may include a diagonal connecting the right of the display with the left of the display (e.g., a diagonal connecting one point of a display panel 143 of FIGS. 4 to 8 with the other point).

According to various embodiments, the at least one processor may be configured to determine whether a screen movement direction according to the user input is identical to the gate scan direction and detect a screen movement speed according to an input associated with the screen movement as the user input is received, when the screen movement direction is not identical to the gate scan direction.

According to various embodiments, a method for compensating for screen movement of a display may include outputting a screen on the display, receiving a user input, determining whether a screen movement direction according to the user input is identical to a gate scan direction, when the user input is an input associated with screen movement, detecting a screen movement speed according to the input associated with the screen movement, when the screen movement direction is not identical to the gate scan direction, and differently determining a compensation value associated with a degree to whether a current screen frame is inclined, depending on the screen movement speed.

According to various embodiments, the differently determining of the compensation value may include determining a number to equally divide the current screen frame, dividing each of the equally divided screen regions into a central region, a data copy region, and a data truncation region in the current screen frame, and performing a compensation operation of adding additional data to the data copy region and removing and displaying candidate data from the data truncation region, while moving the central region in a direction opposite to a screen movement direction. The method may further include differently assigning sizes of the data copy region and the data truncation region depending on a magnitude of the screen movement speed or differently determining the number of the additional data and the number of the candidate data depending on a location of an equally divided screen region.

According to various embodiments, the detecting of the screen movement speed may include detecting the screen movement speed based on a change in pixel information on a diagonal segment connecting a first point of the display with a second point of the display. The compensation operation may include extracting an ROI from a screen displayed on the display, detecting the screen movement speed within the ROI, and adding additional data or removing the candidate data depending on a screen movement speed on the ROI.

Meanwhile, an electronic device, according to an embodiment of the disclosure, for determining an amount of compensation according to a screen movement speed and performing screen compensation based on the screen movement speed by applying the amount of compensation is also applicable to a foldable display device. The foldable display device (or a foldable device or a foldable electronic device) may include a first housing, a second housing, and at least one hinge structure disposed between the first housing and the second housing. The foldable display device may further include a hinge housing surrounding the hinge structure. A display, a central portion of which is foldable, may be disposed on an upper portion of the first housing, the second housing, and the hinge structure. The at least one processor may be located in at least one of the first housing and the second housing. The at least one hinge structure may include a hinge structure, a central portion of which adopts a gear structure, at least one detent hinge structure capable of providing a sense of detent, and at least one hinge structure where a gear structure is excepted from both sides to prevent the housing from being twisted. At least one plate covering the hinge structure may be disposed between the display and the hinge structure. According to various embodiments, a plate (e.g., a plate or a sheet adopting a lattice structure) for protecting the display may be further disposed between one surface composed of the first housing, the second housing, and the hinge structure and a rear surface of the display. The foldable electronic device may have an unfolding state, a holding state at a specified angle (a folding angle of 90 degrees, 120 degrees, 140 degrees, 160 degrees, or the like of the display), or a folding state.

Figure 18:
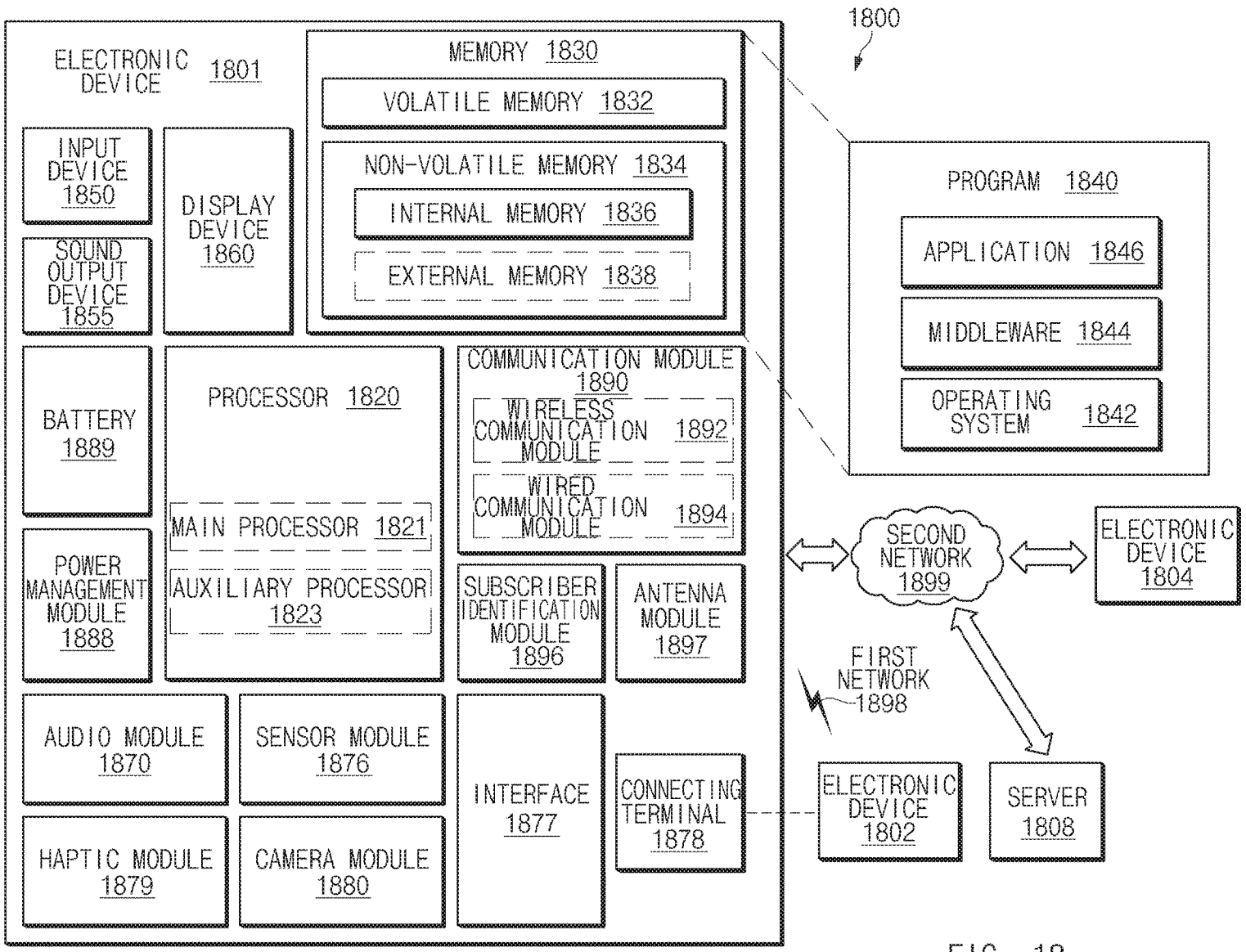
FIG. 18 is a block diagram illustrating an electronic device in a network environment according to an embodiment of the disclosure.

FIG. 18 is a block diagram illustrating an electronic device 1801 in a network environment 1800 according to an embodiment of the disclosure.

Referring to FIG. 18, the electronic device 1801 in the network environment 1800 may communicate with an electronic device 1802 via a first network 1898 (e.g., a short-range wireless communication network), or an electronic device 1804 or a server 1808 via a second network 1899 (e.g., a long-range wireless communication network). According to an embodiment, the electronic device 1801 may communicate with the electronic device 1804 via the server 1808. According to an embodiment, the electronic device 1801 may include a processor 1820, memory 1830, an input device 1850, a sound output device 1855, a display device 1860, an audio module 1870, a sensor module 1876, an interface 1877, a haptic module 1879, a camera module 1880, a power management module 1888, a battery 1889, a communication module 1890, a subscriber identification module (SIM) 1896, or an antenna module 1897. In some embodiments, at least one (e.g., the display device 1860 or the camera module 1880) of the components may be omitted from the electronic device 1801, or one or more other components may be added in the electronic device 1801. In some embodiments, some of the components may be implemented as single integrated circuitry. For example, the sensor module 1876 (e.g., a fingerprint sensor, an iris sensor, or an illuminance sensor) may be implemented as embedded in the display device 1860 (e.g., a display).

The processor 1820 may execute, for example, software (e.g., a program 1840) to control at least one other component (e.g., a hardware or software component) of the electronic device 1801 coupled with the processor 1820, and may perform various data processing or computation. According to one embodiment, as at least part of the data processing or computation, the processor 1820 may load a command or data received from another component (e.g., the sensor module 1876 or the communication module 1890) in volatile memory 1832, process the command or the data stored in the volatile memory 1832, and store resulting data in non-volatile memory 1834. According to an embodiment, the processor 1820 may include a main processor 1821 (e.g., a central processing unit (CPU) or an application processor (AP)), and an auxiliary processor 1823 (e.g., a graphics processing unit (GPU), an image signal processor (ISP), a sensor hub processor, or a communication processor (CP)) that is operable independently from, or in conjunction with, the main processor 1821. Additionally or alternatively, the auxiliary processor 1823 may be adapted to consume less power than the main processor 1821, or to be specific to a specified function. The auxiliary processor 1823 may be implemented as separate from, or as part of the main processor 1821.

The auxiliary processor 1823 may control at least some of functions or states related to at least one component (e.g., the display device 1860, the sensor module 1876, or the communication module 1890) among the components of the electronic device 1801, instead of the main processor 1821 while the main processor 1821 is in an inactive (e.g., sleep) state, or together with the main processor 1821 while the main processor 1821 is in an active state (e.g., executing an application). According to an embodiment, the auxiliary processor 1823 (e.g., an image signal processor or a communication processor) may be implemented as part of another component (e.g., the camera module 1880 or the communication module 1890) functionally related to the auxiliary processor 1823.

The memory 1830 may store various data used by at least one component (e.g., the processor 1820 or the sensor module 1876) of the electronic device 1801. The various data may include, for example, software (e.g., the program 1840) and input data or output data for a command related thereto. The memory 1830 may include the volatile memory 1832 or the non-volatile memory 1834.

The program 1840 may be stored in the memory 1830 as software, and may include, for example, an operating system (OS) 1842, middleware 1844, or an application 1846.

The input device 1850 may receive a command or data to be used by another component (e.g., the processor 1820) of the electronic device 1801, from the outside (e.g., a user) of the electronic device 1801. The input device 1850 may include, for example, a microphone, a mouse, a keyboard, or a digital pen (e.g., a stylus pen).

The sound output device 1855 may output sound signals to the outside of the electronic device 1801. The sound output device 1855 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 1860 may visually provide information to the outside (e.g., a user) of the electronic device 1801. The display device 1860 may include, for example, a display, a hologram device, or a projector and control circuitry to control a corresponding one of the display, hologram device, and projector. According to an embodiment, the display device 1860 may include touch circuitry (or touch screen panel integrated chip (TSP IC)) adapted to detect a touch, or sensor circuitry (e.g., a pressure sensor) adapted to measure the intensity of force incurred by the touch.

The audio module 1870 may convert a sound into an electrical signal and vice versa. According to an embodiment, the audio module 1870 may obtain the sound via the input device 1850, or output the sound via the sound output device 1855 or a headphone of an external electronic device (e.g., an electronic device 1802) directly (e.g., wiredly) or wirelessly coupled with the electronic device 1801.

The sensor module 1876 may detect an operational state (e.g., power or temperature) of the electronic device 1801 or an environmental state (e.g., a state of a user) external to the electronic device 1801, and then generate an electrical signal or data value corresponding to the detected state. According to an embodiment, the sensor module 1876 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1877 may support one or more specified protocols to be used for the electronic device 1801 to be coupled with the external electronic device (e.g., the electronic device 1802) directly (e.g., wiredly) or wirelessly. According to an embodiment, the interface 1877 may include, for example, a high definition multimedia interface (HDMI), a universal serial bus (USB) interface, a secure digital (SD) card interface, or an audio interface.

A connecting terminal 1878 may include a connector via which the electronic device 1801 may be physically connected with the external electronic device (e.g., the electronic device 1802). According to an embodiment, the connecting terminal 1878 may include, for example, a HDMI connector, a USB connector, a SD card connector, or an audio connector (e.g., a headphone connector).

The haptic module 1879 may convert an electrical signal into a mechanical stimulus (e.g., a vibration or a movement) or electrical stimulus which may be recognized by a user via his tactile sensation or kinesthetic sensation. According to an embodiment, the haptic module 1879 may include, for example, a motor, a piezoelectric element, or an electric stimulator.

The camera module 1880 may capture an image or moving images. According to an embodiment, the camera module 1880 may include one or more lenses, image sensors, image signal processors, or flashes.

The power management module 1888 may manage power supplied to the electronic device 1801. According to one embodiment, the power management module 1888 may be implemented as at least part of, for example, a power management integrated circuit (PMIC).

The battery 1889 may supply power to at least one component of the electronic device 1801. According to an embodiment, the battery 1889 may include, for example, a primary cell which is not rechargeable, a secondary cell which is rechargeable, or a fuel cell.

The communication module 1890 may support establishing a direct (e.g., wired) communication channel or a wireless communication channel between the electronic device 1801 and the external electronic device (e.g., the electronic device 1802, the electronic device 1804, or the server 1808) and performing communication via the established communication channel. The communication module 1890 may include one or more communication processors that are operable independently from the processor 1820 (e.g., the application processor (AP)) and supports a direct (e.g., wired) communication or a wireless communication. According to an embodiment, the communication module 1890 may include a wireless communication module 1892 (e.g., a cellular communication module, a short-range wireless communication module, or a global navigation satellite system (GNSS) communication module) or a wired communication module 1894 (e.g., a local area network (LAN) communication module or a power line communication (PLC) module). A corresponding one of these communication modules may communicate with the external electronic device via the first network 1898 (e.g., a short-range communication network, such as Bluetooth™ wireless-fidelity (Wi-Fi) direct, or infrared data association (IrDA)) or the second network 1899 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1892 may identify and authenticate the electronic device 1801 in a communication network, such as the first network 1898 or the second network 1899, using subscriber information (e.g., international mobile subscriber identity (IMSI)) stored in the subscriber identification module 1896.

The antenna module 1897 may transmit or receive a signal or power to or from the outside (e.g., the external electronic device) of the electronic device 1801. According to an embodiment, the antenna module 1897 may include an antenna including a radiating element composed of a conductive material or a conductive pattern formed in or on a substrate (e.g., PCB). According to an embodiment, the antenna module 1897 may include a plurality of antennas. In such a case, at least one antenna appropriate for a communication scheme used in the communication network, such as the first network 1898 or the second network 1899, may be selected, for example, by the communication module 1890 (e.g., the wireless communication module 1892) from the plurality of antennas. The signal or the power may then be transmitted or received between the communication module 1890 and the external electronic device via the selected at least one antenna. According to an embodiment, another component (e.g., a radio frequency integrated circuit (RFIC)) other than the radiating element may be additionally formed as part of the antenna module 1897.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1801 and the external electronic device 1804 via the server 1808 coupled with the second network 1899. Each of the electronic devices 1802 and 1804 may be a device of a same type as, or a different type, from the electronic device 1801. According to an embodiment, all or some of operations to be executed at the electronic device 1801 may be executed at one or more of the external electronic devices 1802, 1804, or 1808. For example, if the electronic device 1801 should perform a function or a service automatically, or in response to a request from a user or another device, the electronic device 1801, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1801. The electronic device 1801 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively," as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry." A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 1840) including one or more instructions that are stored in a storage medium (e.g., internal memory 1836 or external memory 1838) that is readable by a machine (e.g., the electronic device 1801). For example, a processor (e.g., the processor 1820) of the machine (e.g., the electronic device 1801) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to various embodiments of the disclosure, the electronic device may support more natural screen movement.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device, comprising:

a display; and at least one processor operatively connected to the display, wherein the at least one processor is configured to:

receive a user input associated with movement of a screen, the screen output on the display, and detect a screen movement speed corresponding to the user input associated with the screen movement, wherein the at least one processor is further configured to:

apply an amount of screen tilt compensation to the screen, the amount of screen tilt compensation determined according to an amount of change of the screen movement speed during a first range of the screen movement speed, maintain the amount of screen tilt compensation independent of a change of the screen movement speed during a second range of the screen movement speed, and output the screen without applying the screen tilt compensation during a third range of the screen movement speed, wherein a screen movement speed of the third range is faster than a screen movement speed of the second range, and wherein the screen movement speed of the second range is faster than a screen movement speed of the first range.

2. The electronic device of claim 1, wherein the amount of screen tilt compensation comprises 0, when the amount of screen tilt compensation is maintained.

3. The electronic device of claim 1, wherein the amount of screen tilt compensation includes a specific value other than 0, when the amount of screen tilt compensation is maintained.

4. The electronic device of claim 1, wherein a change in the amount of screen tilt compensation corresponding to the screen movement speed is a linear change, when determining the amount of screen tilt compensation corresponding to the screen movement based on the screen movement speed in the first range.

5. The electronic device of claim 1, wherein a change in the amount of screen tilt compensation corresponding to the screen movement speed is a non-linear change, when determining the amount of screen tilt compensation corresponding to the screen movement based on the screen movement speed in the first range.

6. The electronic device of claim 1, wherein the at least one processor is further configured to:

determine a number to equally divide a current screen frame, of the screen, into screen regions according to the amount of screen tilt compensation, divide each of the equally divided screen regions into a central region, a data copy region, and a data truncation region in the current screen frame, and perform an operation of adding a certain amount of data to, and displaying the certain amount of data in, the data copy region, and removing the certain amount of data from the data truncation region while moving the central region in a direction opposite to the movement of the screen.

7. The electronic device of claim 6, wherein the at least one processor differently assigns sizes of the data copy region and the data truncation region according to the amount of screen tilt compensation.

8. The electronic device of claim 6, wherein the data copy region is a region disposed in a first direction of the display, when the screen movement direction is from the first direction to a second direction, wherein the data truncation region is a region disposed in the second direction of the display, when the screen movement direction is from the first direction to the second direction, wherein the data copy region is a region disposed in the second direction of the display, when the screen movement direction is from the second direction to the first direction, and wherein the data truncation region is a region disposed in the first direction of the display, when the screen movement direction is from the second direction to the first direction.

9. The electronic device of claim 8, wherein the region disposed in the first direction and the region disposed in the second direction vary in size with respect to a location of an equally divided screen region of the equally divided screen regions.

10. The electronic device of claim 9, wherein the at least one processor is further configured to assign a data copy region of screen regions being updated earlier by a gate driver to be larger or smaller than a data copy region of screen regions being updated later by the gate driver.

11. The electronic device of claim 9, wherein the at least one processor is further configured to assign a data truncation region of screen regions being updated earlier by a gate driver to be smaller or greater than a data truncation region of screen regions being updated later by the gate driver.

12. The electronic device of claim 6, wherein the at least one processor divides a plurality of pixel lines included in the data copy region into a plurality of groups and generates data to be added through interpolation of pixel lines in each of the plurality of groups, and wherein the certain amount of the data to be added is differently determined with respect to a location of an equally divided screen region of the equally divided screen regions.

13. The electronic device of claim 6, wherein the at least one processor divides a plurality of pixel lines included in the data truncation region into a plurality of groups and determines the certain amount of the data to be removed, using data on respective pixel lines included in the plurality of groups, and wherein the certain amount of the data to be removed is differently determined with respect to a location of an equally divided screen region of the equally divided screen regions.

14. The electronic device of claim 6, wherein the at least one processor is further configured to assign a larger number to equally divide the current screen frame as the amount of screen tilt compensation increases.

15. The electronic device of claim 6, wherein the at least one processor is further configured to:

extract a region of interest (ROI) from the screen displayed on the display; and add and remove the certain amount of data within the ROI.

16. The electronic device of claim 6, wherein the at least one processor is further configured to detect the screen movement speed based on a change in pixel information on a segment connecting a first point of the display with a second point of the display.

17. The electronic device of claim 16, wherein the segment includes a diagonal connecting a right part of the display with a left part of the display.

18. The electronic device of claim 1, wherein the at least one processor is further configured to:

determine whether a screen movement direction corresponding to the user input is identical to a gate scan direction, and detect the screen movement speed corresponding to the user input associated with the screen movement as the user input is received, when the screen movement direction is not identical to the gate scan direction.

19. A method of compensating for screen movement of a display of an electronic device, the method comprising:

receiving a user input associated with movement of a screen, the screen output on the display;

detecting a screen movement speed corresponding to the user input associated with the screen movement;

applying an amount of screen tilt compensation to the screen, the amount of screen tilt compensation determined according to an amount of change of the screen movement speed during a first range of the screen movement speed;

maintaining the amount of screen tilt compensation independent of a change of the screen movement speed during a second range of the screen movement speed; and outputting the screen without applying the screen tilt compensation during a third range of the screen movement speed, wherein a screen movement speed of the third range is faster than a screen movement speed of the second range, and wherein the screen movement speed of the second range is faster than a screen movement speed of the first range.

* * * * *